US010217450B2

(12) United States Patent
Baker

(10) Patent No.: US 10,217,450 B2
(45) Date of Patent: Feb. 26, 2019

(54) HUMBUCKING SWITCHING ARRANGEMENTS AND METHODS FOR STRINGED INSTRUMENT PICKUPS

(71) Applicant: Donald L Baker, Tulsa, OK (US)

(72) Inventor: Donald L Baker, Tulsa, OK (US)

( * ) Notice: Subject to any disclaimer, the term of this patent is extended or adjusted under 35 U.S.C. 154(b) by 0 days.

(21) Appl. No.: 15/616,396

(22) Filed: Jun. 7, 2017

(65) Prior Publication Data

US 2018/0357993 A1 Dec. 13, 2018

(51) Int. Cl.
*G10H 3/18* (2006.01)

(52) U.S. Cl.
CPC ..... *G10H 3/182* (2013.01); *G10H 3/186* (2013.01); *G10H 2220/505* (2013.01)

(58) Field of Classification Search
CPC ..... G10H 3/18; G10H 3/12–3/22
USPC ..... 187/726; 84/723–734
See application file for complete search history.

(56) References Cited

U.S. PATENT DOCUMENTS 2,026,841 A 1/1936 Lesti
2,896,491 A 7/1959 Lover
2,976,755 A 3/1961 Fender
3,290,424 A 12/1966 Fender
4,175,462 A * 11/1979 Simon ..... G10H 3/182 84/602
4,305,320 A * 12/1981 Peavey ..... G10H 3/182 84/737
4,501,185 A 2/1985 Blucher
4,711,149 A * 12/1987 Starr ..... G10H 3/182 84/477 R
4,817,486 A * 4/1989 Saunders ..... G10H 1/24 84/725
5,136,919 A * 8/1992 Wolstein ..... G10H 1/08 84/735
5,168,117 A 12/1992 Anderson
5,311,806 A * 5/1994 Riboloff ..... G10H 3/182 84/728
5,763,808 A * 6/1998 Thomson ..... G10H 3/182 84/728
6,121,537 A * 9/2000 Pawar ..... G10H 3/182 84/728
6,316,713 B1 * 11/2001 Furst ..... G10H 1/0008 84/726
6,781,050 B2 * 8/2004 Olvera ..... G10H 3/182 84/453
6,888,057 B2 * 5/2005 Juszkiewicz ..... G10H 1/0058 84/645

(Continued)

*Primary Examiner* — David Warren

(57) ABSTRACT

This invention develops the math and topology necessary to determine the potential number of tonally distinct connections of sensors, musical vibration sensors in particular. It claims the methods and sensor topological circuit combinations, including phase reversals from inverting sensor connections, up to any arbitrary number of sensors, excepting those already patented or in use. It distinguishes which of those sensor topological circuit combinations are humbucking for electromagnetic pickups. It presents a micro-controller system driving a crosspoint switch, with a simplified human interface, which allows a shift from bright to warm tones and back, particularly for humbucking outputs, without the user needing to know which pickups are used in what combinations. It suggests the limits of mechanical switches and develops a pickup switching system for dual-coil humbucking pickups.

22 Claims, 12 Drawing Sheets

(56) References Cited

U.S. PATENT DOCUMENTS 6,998,529 B2 2/2006 Wnorowski
7,276,657 B2 * 10/2007 Bro ..... G10H 1/18 84/723
7,999,171 B1 * 8/2011 Hamilton ..... G10H 3/186 84/727
8,479,143 B1 * 7/2013 Baeckler ..... G06F 17/505 707/999.104
9,196,235 B2 11/2015 Ball et al.
9,401,134 B2 7/2016 Baker
9,640,162 B2 * 5/2017 Ball ..... G10H 1/18
9,704,464 B1 * 7/2017 Petschulat ..... G10H 3/181
2003/0110508 A1 * 6/2003 Bridgelall ..... H04N 7/147 725/117
2003/0145715 A1 * 8/2003 Wnorowski ..... G10H 3/182 84/726
2004/0100944 A1 * 5/2004 Richmond ..... H04L 45/02 370/360
2004/0210575 A1 * 10/2004 Bean ..... G06K 9/00442
2005/0125756 A1 * 6/2005 Ditlow ..... G06F 17/5072 716/124
2005/0150364 A1 7/2005 Krozack et al.
2006/0011051 A1 * 1/2006 Aivbrosino ..... G10H 1/18 84/742
2006/0101340 A1 * 5/2006 Sridhar ..... H04L 41/12 715/734
2007/0251374 A1 * 11/2007 Armstrong-Muntner ..... G10H 3/182 84/735
2009/0308233 A1 * 12/2009 Jacob ..... G10H 1/18 84/726
2010/0124130 A1 * 5/2010 Oh ..... G11C 7/1051 365/193
2010/0208916 A1 * 8/2010 Jacob ..... G10H 1/18 381/104
2012/0024129 A1 * 2/2012 Ball ..... G10H 1/18 84/602
2012/0036983 A1 * 2/2012 Ambrosino ..... G10H 3/143 84/731
2013/0325899 A1 * 12/2013 Mohaban ..... G06Q 10/10 707/791
2014/0150630 A1 * 6/2014 Juszkiewicz ..... G10H 1/44 84/626
2016/0027422 A1 * 1/2016 Baker ..... G10H 3/22 84/726
2017/0228389 A1 * 8/2017 Mohaban ..... G06F 17/30106

* cited by examiner

© 2017 don baker dba android originals LC

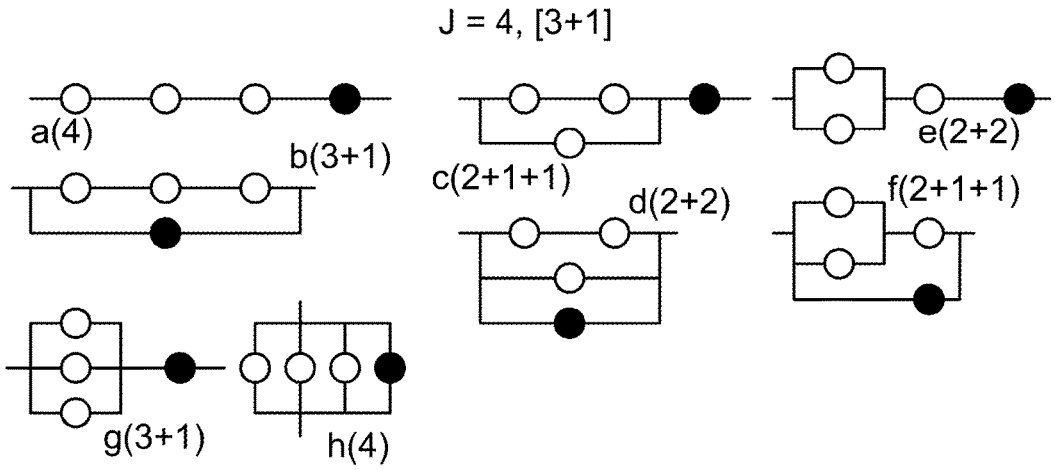
Fig. 2a
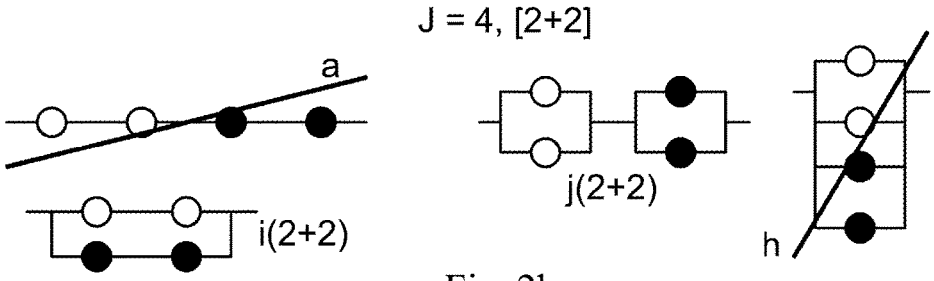
Fig. 2b
FIG. 2
© 2017 don baker dba android originals LC

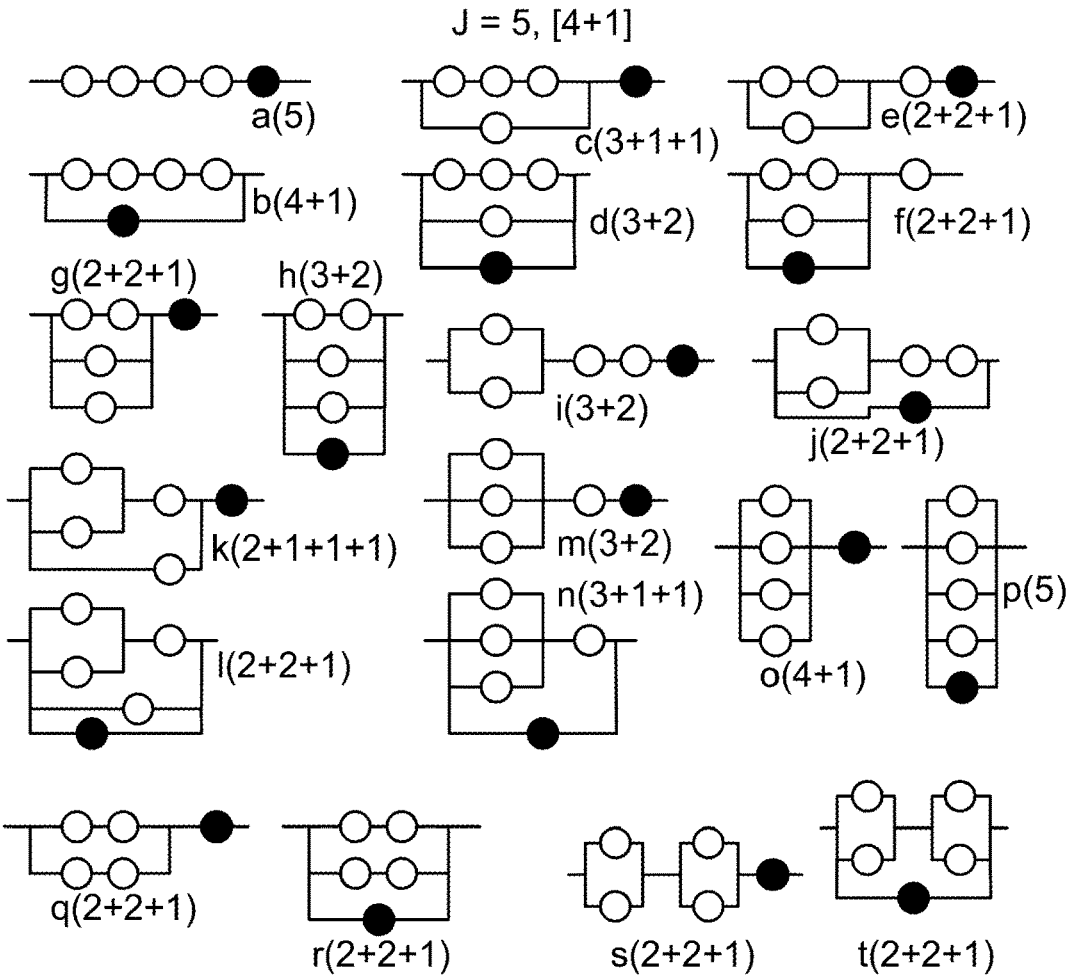
Fig. 3a
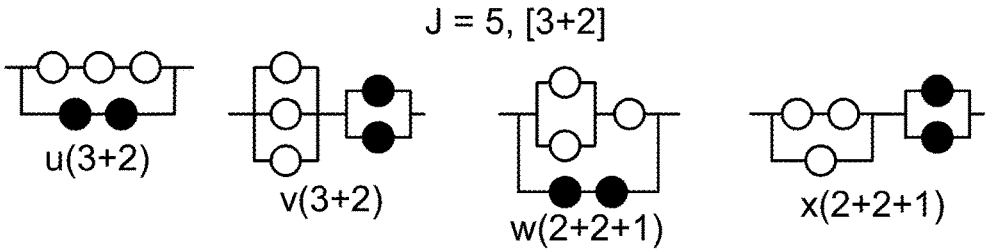
Fig. 3b
FIG. 3
© 2017 don baker dba android originals LC © 2017 don baker dba android originals LC © 2017 don baker dba android originals LC © 2017 don baker dba android originals LC © 2017 don baker dba android originals LC © 2017 don baker dba android originals LC © 2017 don baker dba android originals LC © 2017 don baker dba android originals LC © 2017 don baker dba android originals LC © 2017 don baker dba android originals LC

HUMBUCKING SWITCHING ARRANGEMENTS AND METHODS FOR STRINGED INSTRUMENT PICKUPS

COPYRIGHT AUTHORIZATION

Other than for confidential and/or necessary use inside the Patent and Trademark Office, this authorization is denied until the Nonprovisional Patent Application is published (pending any request for delay of publication), at which time it may be taken to state:

The entirety of this application, specification, claims, abstract, drawings, tables, formulae etc., is protected by copyright: © 2017 Donald L. Baker dba android originals LLC. The (copyright or mask work) owner has no objection to the facsimile reproduction by anyone of the patent document or the patent disclosure, as it appears in the Patent and Trademark Office patent file or records, but otherwise reserves all (copyright or mask work) rights whatsoever.

CROSS-REFERENCE TO RELATED APPLICATIONS

This application is related to U.S. Pat. No. 9,401,134 B2, filed Jul. 23, 2014 and granted Jul. 26, 2016, and the related Provisional Patent Application No. 62/355,852, filed Jun. 28, 2016, and No. 62/370,197, filed Aug. 2, 2016 by this inventor, Donald L. Baker dba android originals LC, Tulsa Okla. USA

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable

Incorporation-by-Reference of Material Submitted on a Compact Disc or as a Text File Via the Office Electronic Filing System (EFS-WEB)

Not Applicable

STATEMENTS REGARDING PRIOR DISCLOSURES BY THE INVENTOR OR A JOINT INVENTOR

Some material may have been disclosed in tutorial articles on the web site TulsaSoundGuitars.com and the sub-site HumbuckingPairs.com. This is a matter for the Patent Office to decide.

TECHNICAL FIELD

This invention relates to the electronic design of stringed instruments, including guitars, sitars, basses, viols and in some cases pianos, including the areas of the control of the timbre of electromagnetic and other transducers by means of combinatorial switching and analog signal processing. Some of the principles will also apply to combinations of other vibration sensors, such as microphone and piezoelectric pickups, placed in or on different parts of a musical instrument, stringed or not.

Background and Prior Art

Please find here a brief description of prior art, and a longer description of the mathematical background which determines the systematic construction of topologies and combinations of electromagnetic string vibration sensors, which determine the possible number and types of such with unique tonal signatures.

Humbucking Pickups

The previous patent, (U.S. Pat. No. 9,401,134, 2016, Baker) from which this application and development derives, established the concept of humbucking pairs and switching systems for single-coil electromagnetic pickups with coils of equal, matched turns. Dual-coil humbucking pickups also have coils of equal matched turns, as demonstrated in the patents of Lesti (U.S. Pat. No. 2,026,841, 1936), Lover (U.S. Pat. No. 2,896,491, 1959), Blucher (U.S. Pat. No. 4,501,185, 1985) and Fender (U.S. Pat. No. 2,976,755, 1961). At least one patent describes a dual-coil humbucker with one coil and poles adjacent the strings, and the other vertically in line and below (Anderson, U.S. Pat. No. 5,168,117, 1992), sometimes called "stacked coils". Either can be used with this patent, but the discussion generally refers to side-by-side humbucking pickups with two coil of opposite poles pointed up at the strings. Pickups designated as "matched" must extend to those which have the same response to external magnetic fields, whether the number of turns are matched or not.

Humbuckers with two matched coils can have those coils connected in either series or parallel. Individual humbuckers commonly have either 4 wires, 2 for each coil, or 2 wires, with the coils connected in series for maximum voltage output, often with a shield wire connected to the metal parts of the humbucker and the pickup cable shield. Guitars with two humbuckers commonly have a 3-way switch, which offers for output the bridge humbucker, the neck humbucker, and the two connected in parallel. Some guitars combine two humbuckers, one and the neck and one at the bridge, with a single-coil pickup mounted in between them. Some use as many as 3 humbuckers. Electric bass guitars are another matter, often containing only two single-coil pickups.

The standard 5-way switch on an electric guitar with 3 single-coil pickups typically provides to the output: the neck coil, the neck and middle coils in parallel, the middle coil, the middle and bridge coils in parallel, and the bridge coil. Typically, in a 3-coil guitar, the middle pickup has the opposite pole up from the other two, the middle and neck coils have roughly equal numbers of turns, and the bridge coil has more turns than the other two to produce a roughly equal signal from the smaller physical vibrations of the strings nearer the bridge. This inventor could find no patent which specified or claimed humbucking for the neck-middle and middle-bridge combinations, but those connections are more humbucking than single coils alone.

Electromechanical Pickup Switching Systems

The Fender Marauder guitar (Fender, U.S. Pat. No. 3,290,424, 1966) had four single-coil pickups with alternating north and south poles up (i.e., N,S,N,S from bridge to neck, or S,N,S,N), connected in parallel to the output with 2P3T switches, such that each pickup could be connected either in-phase, or out-of-phase (contra-phase), or not at all. This amounted to $3^4=81$ different possible parallel connections, of which one of those outputs had no connection to any of the pickups, leaving 80 with outputs.

The Fender switches allow for basic circuit topologies with single pickups connected to the output, and parallel connections between 2, 3 and 4 pickups connected to the output. Ignoring phases, this means 4 things taken 1 at time, or 4 choices, 4 things taken 2 at a time, or 6 choices, 4 things taken 3 at a time, or 6 choices, and 4 things taken 4 at a time, or 1 choice. According to the Specification of this patent below, the human ear can detect only 1 unique phase for 1 pickup, 2 unique phase connections for a circuit of 2 pickups, 4 unique phase connections for a circuit with 3 pickups, and 8 unique phase connections for a circuit of 4 pickups. The products then show 4*1+6*2+6*4+1*8=48 possibly unique tones out of the 80 switch combinations with outputs, leaving 32 duplicate tones.

If the pickups are placed and designated as (N1, S1, N2, S2) from bridge to neck respectively, humbucking pairs analysis, according to U.S. Pat. No. 9,401,134 (Baker, 2016), predicts the following 8 unique humbucking parallel outputs with potentially unique tones: (N1, S1), (N1, −N2), (N1, S2), (S1, N2), (S1, −S2), (N2, S2), (N1, S1, N2, S2), (N1, S1, −N2, −S2), where a minus sign indicates an inverted phase. An additional 8 outputs are humbucking, but merely of inverted relative phase, and thus indistinguishable to the human ear. The remaining 80−16=64 outputs (which actually have an output) allow hum from external sources. As far as can be determined, Fender never provided a switching map to the humbucking outputs. Reportedly for this reason, the Marauder gained a reputation for noisy outputs and failed in the marketplace.

Krozack, et al., (US 2005/0150364A1, 2005) developed for Paul Reed Smith Guitars a switching system for two humbuckers, one each at the neck and bridge, and a single-coil pickup in between, presumably for the PRS 513 guitar, which boasts 13 distinct outputs from five coils. It uses a switching system based upon individual taps on each coil of each humbucker, to obtain nearly equal levels of output for all the switch positions. But it includes single-coil outputs and makes no claim that all outputs are humbucking. Nor does it seem to make any claim on the total number of possible outputs.

Wronowski (U.S. Pat. No. 6,998,529 B2, 2006) patented a switching system for 3 pickups, use 3 DP3T (center-off) switches to set the polarity or phase of each pickups and connection to the circuit. It then uses 3 DPDT switches to connect the chosen pickups in various series and parallel combinations. This produces $3^3*2^3=216$ possible switch positions. If all the pickups are connected, regardless of phase, it has 7 basic topologies: (1+2+3), (1+2), (2+3), (1)||(2+3), (2)||(1+3), (3)||(1+2) and (1)||(2)||(3), where "+" means series connection and "||" means a parallel connection. If any pickup in a series connection is not connected, then the entire series connection is broken, removing that output. Removing a pickup from a parallel connection leaves the other pickup(s) connected to the output.

Without regard to phase, this leaves the following 14 valid connections to the output: (1), (2), (3), (1+2), (1+3), (2+3), (1+2+3), (1)||(2)||(3), (1)||(2), (1)||(3), (2)||(3), (1)||(2+3), (2)||(1+3), (3)||(1+2). According to the presentation in the Specification here, the human ear can detect only 1 unique phase from one pickup, 2 unique phases from two pickups, and 4 unique phases from 3 pickups. This produces 1, 1, 1, 2, 2, 2, 4, 4, 2, 2, 2, 4, 4, & 4 unique tone/phase combinations, respectively, for a total of 35 unique outputs out of 216 different switch combinations. Of all the other 181 combinations about 21 will have no output, and the rest duplicate tones.

Of the 14 unique topologies, only those with two pickups can be humbucking, if only the pickups have equal responses to external hum, with just one valid phase per combination, depending on the orientation of the magnetic poles of the pickups. This leaves 6 possibilities out of 216. Wronowski's switch table in his FIG. 7 does not indicate this complexity. Thus the 2006 Wronowski patent shares similar switching qualities, and then some, of the 1996 Fender patent, with which no guitar is currently made.

In a patent application for dual humbucker guitar, Jacob (US 2009/0308233 A1, 2009) describes a "programmable switch", and claims an improvement upon the Krozack patent, disclosing a "bug", with only minimal reference to tapped coils. Jacob splits his programmable switch into two functions, a selector which chooses the pickup elements to be combined, and a connector which "configures those selected elements in to a wide range of topologies". Jacob makes no claim for concatenating selector switches, and no analysis of which outputs are tonally distinct, apparently assuming that all are.

In his FIG. 11, making use of a set of jumpers and switches, Jacob claims 24 outputs for 2 humbuckers, considering the individual coils singly and in pairs, without making any overall claim for humbucking outputs. Let one describe his pickup coils to be in order, from top to bottom, N1, S1, N2 & S2, for the coil poles up in humbuckers 1, top and 2, bottom, the rows of his FIG. 11 to be 1, 2, 3, 4, 5*a*, 5*b*, and the columns to be a, b, c &d. In this space, only 1*a*, 1*b*, 2*d*, 3*a*, 3*b*, 4*a*, 4*b*, 5*a-d*, 5*b-a* & 5*b-b* are humbucking, for a total of 10, or 41.7%. Of the single-coil choices in column c, 4*c* duplicates 1*a*, and 5*a-c* & 5*b-c* duplicate 3*c*.

The close physical spacing of the coils in each humbucker, plus the fact that they share the same magnetic circuit and field and can act as a transformer, will produce close tonal outputs for the humbucking pairs (3*a*,4*a*), (3*b*, 4*b*), and (2*d*,5*a-d*), and for the non-humbucking pairs (2*a*, 5*a-a*), (2*b*,5*a-b*) and (3*d*,4*d*). This leaves only 15 distinct tones out of the 24, or 62.5%, and only 7 distinct humbucking tones out of 24 outputs, or 29.2%. According to the analysis below, even discarding choices for matched pickups which circuit theory rates as equivalent, two humbuckers could have produced up to 20 distinct humbucking tones, taking the humbuckers connected separately and in pairs, with internal coils connected either in series or parallel. Jacob makes no claims in this regard, thus his range of topologies cannot be a wide as possible, even including non-humbucking choices.

In his FIGS. 8 & 9, Jacob shows two programmable switches, one for "Element Selection" connected to one for "Topology Selection". It seems that "XPMT" and "YPMT" indicate x-pole and y-pole multiple throw, or MT, mechanical switches. Although he presents solid state switches in his FIG. 5, he does not apply them to any cross-point switching, but instead to a "program bank". Separate "element" and "topology" selection switches are not necessary. Baker (U.S. Pat. No. 9,401,134, 2016, FIG. 30) combines both switches in a single cross-point patch board, as noted in claim 37, simplifying the switching and allowing a more flexible way to choose diverse humbucking topologies. Using a 6P6T switch for 4 matched single-coil pickups, it had sufficient cross-point connections to allow for combinations of any 6 of many of the 45 humbucking pairs and quads shown below in Math 31, excluding a number of cases of humbucking quads, especially those involving sub-pairs in quads with inverted signals, i.e., (−AB), which would have required a 7-pole switch for item 375 (U.S. Pat. No. 9,401,134), 7 lines of input for each section of the cross-point board, 377 (U.S. Pat. No. 9,401,134), and 4 interconnection lines instead of the 3 shown (387, U.S. Pat. No. 9,401,134).

Microcontrollers in Guitar Pickup Switching

Ball, et al. (U.S. Pat. No. 9,196,235, 2015; U.S. Pat. No. 9,640,162, 2017) describe a "Microcprocessor" controlling a "Switching Matrix", with a wide number of pickups, preamps and controls hung onto those two boxes without much specification as to how the individual parts are connected together to function in which manners. It makes no mention or claim of any connections to produce humbucking combinations, and could just as well be describing analog-digital controls for a radio, or record player or MPEG device. It states, "On board controls are similar to or exactly the same as conventional guitar/bass controls." This does not allow for any other possible human interface devices, such as up-down tone-shift levers, touch-sensors, mouse-type scroll wheels, status lights or digital matrix pixel displays.

These two patents seem to be related to the Music Man "Game Changer" guitar, which has two humbuckers, one each at neck and bridge, and a single-coil pickup in between them. For which Ernie Ball/Music Man has claimed "over 250,000" choices of pickup tonal output combinations from five coils, without any known claim that all such outputs are humbucking. By contrast, Math 11 shows the actual number of potential tonally distinct interconnections of 5 coils to be only 8512, humbucking or not.

Claiming precedence from PPA 62/355,852, this patent expands the concepts of humbucking pairs of matched single coils to combinations of different poles in different positions, using the example of four matched pickups with (N, S, S, N) poles up, (N, S, N, N) poles up and (N, N, N, N) poles up to examine the maximum possible changes in tonal output, and offers a way to concatenate ordinary electromechanical switches to any number of humbucking pairs.

Claiming precedence from PPA 62/370,197, this patent extends the concepts of humbucking pairs of matched single-coil pickups (U.S. Pat. No. 9,401,134, 2016, Baker) to humbucking quads, hexes, octets and above, by constructing more complex orders of combinations from lower orders in series and parallel, and by systematic reversal of connections for out-of-phase contributions. Also by connecting dual-coil humbuckers together into larger quads, hexes, etc., using the same methods. It uses reasonable conjecture and inductive mathematical proof to develop formulas for the numbers of potential tonally distinct humbucking combinations of single-coil and dual-coil humbucker pickups.

SUMMARY OF INVENTION

This invention makes the point that all possible and potentially useful two-terminal sensor or pickup circuits can be determined, so that switching systems can be designed that don't produce either a lot of duplicated tones, or tones that are non-humbucking, and thus noisy. This invention develops the math, phases and topologies necessary to determine just how many unique tones one may get from the numbers of pickups that can reasonably fit on or in a stringed instrument, particularly guitars. This increases the number of possible tones up to orders of magnitude over current choices using 3-way and 5-way electromechanical switches. Then applies these developments to describe switching systems which may be constructed with commonly-available electromechanical switches, and commonly-available micro-controllers and crosspoint switches. It also describes a new approach to micro-controller and crosspoint switch switching, which introduces the concept of a tonal shift lever, for going nearly monotonically from bright to warm tones. This allows very simple control inputs which relieve the user from having to memorize and know the combinations of pickups needed to produce desired tones. This patent application claims all topologies and tonalities developed for any number sensors of number J from 1 to infinity, constructed by the methods shown here, except for those already in the public domain and/or protected by patent.

Technical Problems Found and Resolved

The vast majority of current electric guitars with electromagnetic pickups use either 3-way or 5-way pickup switches, failing to take advantage of the number of possible humbucking pickup combinations. A dual-humbucker guitar with a 3-way switch misses up to 17 more possible outputs. A 3-coil guitar with a 5-way switch produces only 2 potentially humbucking outputs, when it could have 6. Other patented guitars claim from 80 to over 250,000 separate tonal outputs, when in fact from 50% up to 96% of those are tonal duplicates, and a small fraction of the remaining are humbucking. The math and topology developed here establish the potential number and connections of tonally different humbucking outputs, in pairs, quads, hextets and octets of matched single-coil pickups, and pairs, triples and quads for dual-coil humbuckers, raising the possible number of potential humbucking outputs up to an order of magnitude or more. For example, up to 6 humbucking combinations for 3 matched single-coil pickups, 48 for 4 pickups, 200 for 5 pickups, 3130 for 6 pickups, 19,222 for 7 pickups and 394,452 for 8 pickups; and up to 20 for 2 dual-coil humbuckers, 310 for 3 humbuckers and 8552 for 4 humbuckers.

With so many possible different tonal combinations of pickups, electromechanical switches soon reach their limits for any arrangement above 3 single-coil or 2 humbucking pickups. This virtually mandates the use of a digitally-controlled, analog crosspoint switch. Furthermore, guitars which have incorporated digital signal processing, such as digital string tuning, interfere with the magic between the fingers and the strings. Even as some electric guitars move to digital electronic switching, they offer no map to the tonal qualities of each output, and the high number of claimed outputs and multiple selection switches are potentially confusing. This invention simplifies the human interface, reducing the selection of tones to a simple up-down selection on a range of bright to warm tones with no need to know which pickups in what combinations are being used. Other communication modes and preset sequences of tones are possible and enabled. Although the switching between pickup combinations in this invention is controlled by a digital micro-controller, the signal path from fingers to output is analog.

Tones which are high up upper harmonics are considered "bright". Tones which are low in upper harmonics are considered "warm". To this inventor's knowledge, no one has developed a means of sorting tonal outputs of any given guitar into sequence from bright to warm tones. This invention does so using the analog-to-digital converter common on many micro-controllers to perform spectral analyses of different pickup combinations, and produce the moments of the resulting frequency spectral density functions, such as the first moment, or mean·frequency, and the second and third moments. An experiment taking Fast Fourier Transforms of the outputs of a dual-humbucker guitar with an effective 20-way switch demonstrates that by mean·frequency, up to 17 of those humbucking outputs can be considered tonally different. This inventor could find no reference to any similar measurements to demonstrate tonal distinctions for any other enhanced-output guitar.

Glossary of Necessary Terms

These are standard electronic terms and/or terms declared here for the purpose keeping track of separate objects and concepts:

Base topology—a collection of one or more sensors all connected in series between two terminals or nodes of a circuit or topology, or alternatively all connected in parallel between two terminals, such that the mere order of connection of sensors in the topology, without changing phases, cannot change the output of the collection in any manner that the human ear or electrical measuring instrument can detect.

Category—the size of a topology, i.e., the number of sensors in a topology, usually designated here by (J) or (M). or a number in parentheses, i.e., (3)

Parallel connection—two or more two-terminal sensors with one terminal each connected to one circuit node or output terminal, and the other terminal each connected to another circuit node or output terminal.

Phase—the relative reversal of terminals of a sensor or group of sensors in a topology, compared to other sensors in the circuit, such that the human ear can detect a difference.

Series connection—two or more sensors of two terminals each with one terminal of each sensor connected to the next sensor in a line, which in turn is connected to the next, et cetera, until only the outer two terminals are connected either to the circuit output or to two nodes inside a larger circuit.

Signs&pairs—the number of potentially unique outputs due to the use of humbucking pairs, for any number of pairs more than 1, JP 2.

Sub-category—a number or sum of numbers, enclosed here in brackets or parentheses, such as ($M_1+M_2+M_3$) or [4+1] or (3+2+1) or (2+1+1+1), indicating a topology of size M=J or category ($M=M_1+\ldots+M_N$), which is comprised of N number of base topologies, each of size Mi, i=1 to N. The order of Mi number of sensors inside the associated base topology cannot affect the output of the whole, but the reversal of terminal connections of the base topology, or any sensor within it may.

Topology—the electrical connections of sensors or groups of sensors, particularly two-terminal sensors in series or parallel with respect to each other, such that the output also has two terminals.

Versions—in this context, the number of possible topologies within a sub-category in which replacing a single sensor or changing its phase will change the output without changing the topology.

BRIEF DESCRIPTION OF THE DRAWINGS

FIG. 1*a*, is combined to another single sensor to form the series and parallel category (2) circuit topology, with pairs of sensors, FIG. 1*b*, then how for J=3 category (1) and (2) topologies are combined in series and parallel to form circuit topologies of categories (3) and (2+1). The filled-in black circles show where the smaller category was added in series and parallel. FIG. 1*d-e* shows how three sensors, A, B & C, are combined to form the 3 unique versions of FIGS. 1*c-b*(2+1) and 1*c-c*(2+1). In both cases the subcategory basic topology (2) group (series or parallel) show 3 how sensors are taken 2 at a time, with the remaining subcategory (1) determined by the remaining sensor.

FIG. 2 shows how for J=4 subcategories (4), (3+1), (2+2) and (2+1+1) circuit topologies are constructed by adding the category (1) topology to category (3) in series and parallel, FIG. 2*a*, and by adding the category (2) topology to category (2) topology in series and parallel, FIG. 2*b*, discarding 2 topologies already constructed, for a total of 10 topologies, with 2 versions of (4), 2 versions of (3+1), 4 versions of (2+2) and 2 versions of (2+1+1).

FIG. 3 shows how for J=5, 24 topological circuit subcategories of (5), (4+1), (3+2), (3+1+1), (2+2+1) and (2+1+1+1) are constructed by adding category (1) to category (4) topologies, FIG. 3*a*, and category (2) to category (3) topologies, FIG. 3*b*. Discarded duplicate topologies are not shown.

DEVELOPMENT OF TOPOLOGIES, PHASES AND MATH FOR PICKUP COMBINATIONS

Figure 1:
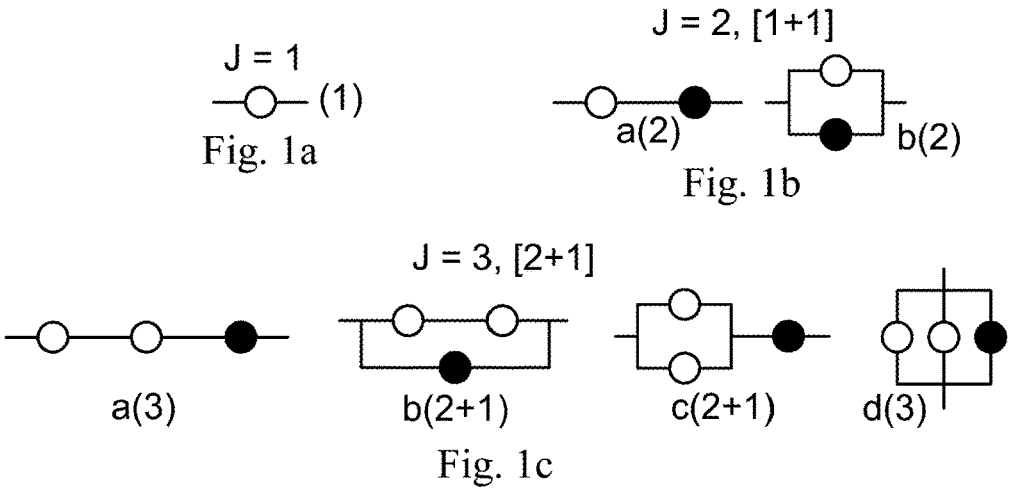
FIG. 1 shows how a single sensor, of category (1) circuit topology.

This is necessary for understanding, to avoid pickup switching combinations that are either tonal duplicates or, if one desires, non-humbucking. It is necessary to understand why previous inventions are flawed, and why this approach is novel. To this inventor's knowledge, no one has yet fully and systematically described how to determine the number of unique tonal combinations of K single-coil pickups taken J at a time, or KK humbucking dual-coil pickups taken JJ at a time. Or how to determine the potential number of unique humbucking tones, using combinations of humbucking pairs (Baker, U.S. Pat. No. 9,401,134, 2016) in larger assemblies of 4, 6, 8 or 10 matched single-coil pickups. This discussion includes certain prototype experiments and prior art as seemed necessary to illustrate the impact of these developments.

Note that while this development focuses on coil and magnet sensors, such principles can also apply to other types of vibration sensors, such as piezoelectric, optical, proximity, hall-effect and other pickups. Since hall-effect sensors also depend upon magnetic field disturbances, they can also be made as matched single device string vibration sensors, or dual device humbucking sensors. They are typically not used in electric guitars because the signals they provide are thus far small enough to require auxiliary amplification, preferable inside the guitar to avoid line noise.

Unique Tonal Combinations of K Sensors Taken J at a Time

Combinations of K Sensors Taken J at a Time

Let us start with two-terminal sensors, such as piezoelectric elements, microphones and single-coil pickups. First topologies, then phases, later combinations of single-coil and dual coil guitar pickups in humbucking combinations. Math 1a-b shows to calculate the number of ways you can choose K things J at a time, where J≤K are both integers. For example, if you have 5 sensors and pick 2 of them to connect in series, you can do this 10 different ways. If you have 3 sensors, A, B & C, you can connect two of them in parallel 3 different ways as: A||B, A||C and B||C, where B||A is the same as A||B. This kind of calculation is basic to this discussion.

$$\binom{K}{J} = \frac{K!}{(K-J)!*J!} = \frac{K*(K-1)* \ \dots \ *(K-J+1)}{J*(J-1)* \ \dots \ *2*1}, K \geq J \qquad \text{Math 1a}$$

$$\text{Examples:} \binom{5}{2} = \frac{5*4}{2*1} = 10, \binom{3}{2} = \frac{3*2}{2*1} = 3.$$

Math 1b. Combinations of K things taken J at a time

| | J | | | | | |
|---|---|---|---|---|---|---|
| K | 1 | 2 | 3 | 4 | 5 | 6 |
| 1 | 1 | | | | | |
| 2 | 2 | 1 | | | | |
| 3 | 3 | 3 | 1 | | | |
| 4 | 4 | 6 | 4 | 1 | | |
| 5 | 5 | 10 | 10 | 5 | 1 | |
| 6 | 6 | 15 | 20 | 15 | 6 | 1 |
| 7 | 7 | 21 | 35 | 35 | 21 | 7 |
| 8 | 8 | 28 | 56 | 70 | 56 | 28 |
| 9 | 9 | 36 | 84 | 126 | 126 | 84 |
| 10 | 10 | 45 | 120 | 210 | 252 | 210 |

Unique Tonal Interconnection Topologies of J Things

For this discussion, consider just the topologies of J things connected either in series or parallel, or some combination thereof. For J=1, there are no interconnections and the number of topologies is only J=(1), where (1) represents a category of only 1 sensor connected between two terminals, as shown in FIG. 1*a*. For J=2, there is only series and parallel, and the number of topologies is only 2, as incidentally shown in FIG. 1*b*. We construct this category (2) topology, labeled a(2) in FIG. 1*b*, merely by adding 1 sensor, designated by the filled circle, in series with 1 sensor, designated by the open circle. And by adding a category (1) sensor topology in parallel with another category (1) sensor topology, labeled b(2) in FIG. 1*b*. By this simple approach, adding equal and lower-category circuit topologies in series and parallel to existing circuit topologies, we construct all possible circuit topologies from previously existing topologies. Note that for category (2), two coils in series or two coils in parallel, the order of connection of the coils does not change the tone of the combination.

For J=3, we construct in FIG. 1*c* all possible category (3) topologies by adding the single category (1) topology in series and parallel with all possible category (2) topologies, indicated by the label J=3, [2+1], where [2+1] is a sub-category. We see from inspection that this creates two sub-categories of circuit topology, (3) and (2+1), which is the same as (3) and (1+2). For sub-category (3), we have 3 sensors in series, FIG. 1*c-a*(3), and 3 sensors in parallel, FIG. 1*c-d*(3). Sub-category (3) has the basic topologies for J=3 with 2 versions. For sub-category (2+1), we have a single sensor in parallel with a series pair, FIG. 1*c-b*(2+1) and a single sensor in series with a parallel pair, FIG. 1*c-c*(2+1), for 2 versions of sub-category (2+1). Note that each version of (2+1) is constructed of a basic topology of category (2) connected to a basic topology of category (1).

Label the 3 sensors in FIG. 1*c-b*(2+1) as A, B & C in FIG. 1*d*. By inspection, we can see that there are only 3 ways to connect these sensors together in this topology. Recall that order of connection does not matter in series or parallel basic topologies. The same is true for the topology in FIG. 1*c-c*(2+1), as shown in FIG. 1*e*. But when the topologies become much more complicated, it is much easier to calculate the combinations, using the inherent combinatorial characteristics of basic topologies in more complex topologies, rather than trying to draw them all out.

Math 2a shows how this is done for each sub-category. For J=3, sub-category (3), there is only 1 combination of 3 things taken 3 at a time. For a sub-category like (2+1) with multiple basic topologies, the combination calculations must be split up and multiplied together. First the (2) part is calculated by taking 3 things 2 at a time, then 2 is subtracted from 3, leaving 1 thing taken 1 at a time. Math 2b shows the combinations in each sub-category multiplied by the number of version in each sub-category, adding up to $J_T$=8 total unique topologies, comprising of FIG. 1*c-a*(3), or A, B & C in series, FIG. 1*c-d*(3), or A, B & C in parallel, plus the combinations in FIGS. 1*d* & 1*e*. $J_T$ in this context is an important number in topologies of all sizes of J. When there are K sensors to be taken J at a time, that combination multiplies by JT to calculate the total number of ways that K sensors can be combined in a set of topologies of size J or category (J), as shown in Math 2c, not counting phase changes, which will be discussed here later.

Math 2a $$3:\binom{3}{3}=1$$

$$2+1:\binom{3}{2}*\binom{3-2}{1}=\binom{3}{2}*\binom{1}{1}=3*1=3.$$

Math 2b $$J_T=\binom{3}{3}*2+\binom{3}{2}*\binom{1}{1}*2=1*2+3*2=8.$$

Math 2c $$\text{Total number of possible connections}=\binom{K}{J}*J_T.$$

FIG. 2*a*, labeled J=4, [3+1], shows how the J=1 topology is combined with J=3 topologies, to obtain the (3+1) sub-category for J=4 topologies. For example, FIGS. 2*a-a*(4) & 2*a-b*(3+1) show a single sensor connected in series and parallel with the topology in FIG. 1*c-a*(3) to obtain 2 new J=4 topologies. As is done with the remaining FIG. 1*c* topologies to obtain a total of 2 (4), 2 (3+1), 2 (2+2) and 2 (2+1+1) subcategory versions. FIG. 2*b* shows how both category (2) topologies are combined to produce 2 new (2+2) versions and 2 topologies already constructed in FIG. 2*a*, which duplicate FIGS. 2*a-a*(4) & 2*a-h*(4). Altogether, there are 4 (2+2) subcategory versions in the J=4 topologies, for a total of 10 versions of J=4 topologies.

We find that in doing so, the topologies for category (2+1+1) are also constructed. For category (2+1+1), two single sensors are connected to a serial or parallel pair of sensors in such a way that the order of choice of the single coils matters to the tone, which we can see by inspection. Math 3a shows the number of tonal combinations of J=4 sensors for each version of topology in a subcategory in FIG. 2, (4), (3+1), (2+2) and (2+1+1). Note how the lower numbers in each of the bracketed combinatorial expressions match the numbers between the parentheses in the subcategory labels. Math 3b shows the number of combinations of sensors times the number of versions of topology in each subcategory to obtain the total number, $J_T$=58 unique topologies, from 4 subcategories.

Math 3a $$4:\binom{4}{4}=1$$

$$3+1:\binom{4}{3}*\binom{4-3}{1}=\binom{4}{3}*\binom{1}{1}=4*1=4$$

$$2+2:\binom{4}{2}*\binom{4-2}{2}=\binom{4}{2}*\binom{2}{2}=6*1=6$$

$$2+1+1:\binom{4}{2}*\binom{4-2}{1}*\binom{4-3}{1}=\binom{4}{2}*\binom{2}{1}*\binom{1}{1}=6*2*1=12.$$

Math 3b $$J_T=\binom{4}{4}*2+\binom{4}{3}*\binom{1}{1}*2+\binom{4}{2}*\binom{2}{2}*4+\binom{4}{2}*\binom{2}{1}*\binom{1}{1}*2$$

$$J_T=1*2+4*2+6*4+12*2=58$$

FIG. 3 shows the constructions of topologies for J=5. FIG. 3*a*, labeled J=5, [4+1], shows those constructed from topological categories (4) and (1). Note that there are 20 new topologies, as one might expect from adding (1) in series and parallel with the 10 topologies of J=4. FIG. 3*b*, labeled J=5, [3+2], shows those constructed from topological categories (3) and (2), leaving out all those previously constructed. This produces the J=5 subcategories of (5) with 2 versions, (4+1) with 2 versions, (3+2) with 6 versions, (3+1+1) with 2 versions, (2+2+1) with 11 versions and (2+1+1+1) with 1 versions, for a total of 6 subcategories and 24 versions of J=5 topologies. Math 4a shows numbers of combinations of J=5 sensors for each of the subcategories, and Math 4b shows their products times the number of versions in each subcategory, for a total of $J_T$=532 unique topologies, from 6 subcategories.

Math 4a $$5:\binom{5}{5}=1$$

-continued $$4+1:\ \binom{5}{4}*\binom{5-4}{1}=\binom{5}{4}*\binom{1}{1}=5*1=5$$

$$3+2:\ \binom{5}{3}*\binom{5-3}{2}=\binom{5}{3}*\binom{2}{2}=10*1=10$$

$$3+1+1:\ \binom{5}{3}*\binom{5-3}{1}*\binom{5-4}{1}=\binom{5}{3}*\binom{2}{1}*\binom{1}{1}=10*2*1=20$$

$$2+2+1:\ \binom{5}{2}*\binom{5-2}{2}*\binom{5-4}{1}=\binom{5}{2}*\binom{3}{2}*\binom{1}{1}=10*3*1=30$$

$$2+1+1+1:\ \binom{5}{2}*\binom{5-2}{1}*\binom{5-3}{1}*\binom{5-4}{1}=\binom{5}{2}*\binom{3}{1}*\binom{2}{1}*\binom{1}{1}=10*3*2*1=60.$$

Math 4b $$J_T=\binom{5}{5}*2+\binom{5}{4}*\binom{1}{1}*2+\binom{5}{3}*\binom{2}{2}*6+\binom{5}{3}*\binom{2}{1}*\binom{1}{1}*2+\binom{5}{2}*\binom{3}{2}*\binom{1}{1}*10+\binom{5}{2}*\binom{3}{1}*\binom{2}{1}*\binom{1}{1}*2$$

$$J_T=1*2+5*2+10*6+20*2+30*11+60*1=502.$$

Without further mathematical demonstration or proof, one may offer the conjecture that in constructing topologies, i.e., for J number of sensors, using topological categories for (J) and smaller, that one only need to make the constructions from pairs of smaller categories, i.e., (J) and (1), then (J-1) and (2), down to (J-n) and (n), where n is an integer greater than or equal to J/2. That from these combinations, all the other sub-categories with 3 or more basic topologies are created, i.e,. ((J-2)+1+1), ((J-3)+2+1), ((J-3)+1+1+1), and others.

For J=6, the topologies have been constructed, but are not shown in figures here. The construction from combining category (5) topologies with the category (1) topology, (4) with (2) and (3) with (3), produced 2 versions of subcategory (6), 2 of (5+1), 5 of (4+2), 2 of (4+1+1), 4 of (3+3), 18 of (3+2+1), 2 of (3+1+1+1), 15 of (2+2+2+2), 20 of (2+2+1+1) and 2 of (2+1+1+1+1), for a total of 72 versions of J=6 topologies. Math 5a shows numbers of combinations of J=6 sensors for each of the subcategories, and Math 5b shows their products times the number of versions in each subcategory, for a total of $J_T$=7219 unique topologies, from 10 subcategories.

Math 5a $$6:\ \binom{6}{6}=1$$

$$5+1:\ \binom{6}{5}*\binom{1}{1}=6*1=6$$

$$4+2:\ \binom{6}{4}*\binom{2}{2}=15*1=15$$

$$4+1+1:\ \binom{6}{4}*\binom{2}{1}*\binom{1}{1}=15*2*1=30$$

-continued $$3+3:\ \binom{6}{3}*\binom{3}{3}=20*1=20$$

$$3+2+1:\ \binom{6}{3}*\binom{3}{2}*\binom{1}{1}=20*3*1=60$$

$$3+1+1+1:\ \binom{6}{3}*\binom{3}{1}*\binom{2}{1}*\binom{1}{1}=20*3*2*1=120$$

$$2+2+2:\ \binom{6}{2}*\binom{4}{2}*\binom{2}{2}=15*6*1=90.$$

$$2+2+1+1:\ \binom{6}{2}*\binom{4}{2}*\binom{2}{1}*\binom{1}{1}=15*6*2*1=180$$

$$2+1+1+1+1:\ \binom{6}{2}*\binom{4}{1}*\binom{3}{1}*\binom{2}{1}*\binom{1}{1}=15*4*3*2*1=360.$$

Math 5a

Math 5b $$J_T=1*2+6*2+15*5+30*2+20*4+60*18+120*2+90*15+180*20+360*2=7219.$$

For J=7, no topologies have been constructed here, but it is reasonable to suppose that they may be constructed from combining category (6) topologies with category (1), (5) with (2), and (4) with (3), producing the 14 subcategories (7), (6+1), (5+2), (4+3), (5+1+1), (4+2+1), (4+1+1+1), (3+3+1), (3+2+2), (3+2+1+1), (3+1+1+1+1), (2+2+2+1), (2+2+1+1+1), and (2+1+1+1+1+1). Let C denote the number of subcategories for J, and $J_V$ the number of versions for J. Math 6 shows C, $J_V$ and $J_T$ for the topologies already constructed.

Math 6. Sensor topology characteristics for J = 1 to 6

| J | C | $J_V$ | $J_T$ |
|---|---|---|---|
| 1 | 1 | 1 | 1 |
| 2 | 1 | 2 | 2 |
| 3 | 2 | 4 | 8 |
| 4 | 4 | 10 | 58 |
| 5 | 6 | 24 | 502 |
| 6 | 10 | 72 | 7219 |

When $J_V$ and $J_T$ are plotted against C in log-log space, the last three points, for C=4, 6 & 10 plot in nearly a straight line, suggesting $J_V$=exp(a+b*ln(C)) and $J_T$=exp(c+d*ln(C)). When these functions are fitted and calculated for J=7 and C=14, $J_y$ is estimated to be about 148, and $J_T$ about 43,000. However, this may be a moot point for small, portable stringed instruments like guitars. With more sensors closer together, the separation of adjacent unique tones decreases, so that it may not be either practical nor necessary to get a good range of tones with a lot of sensors. More sensors along the strings may make more sense with non-fingered stringed instruments like pianos, where the whole length of any string can be used to generate electronic tones.

Unique Tonal Phase Combinations of J Things

Without any other reference signal, neither the human ear nor electronics can determine the phase of a signal of a single frequency. The human ear cannot hear tonal difference between the signal sin(ωt) and the signal −sin(ωt)=sin(−ωt), where ω=2πf, and f is the frequency in Hertz or cycles per second. If the phase is designated as (+) for the signal sin(ωt) and (−) for the signal −sin(ωt), then without any other reference signal there is no tonal difference between (+) and (−). If there are two signals, the phase combinations can be designated (+,+), (+,−), (−,+) and (−,−), but only two are tonally unique for the human ear, since −(+,−)=(−,+) and −(+.+)=(−,−).

We can construct a diagram of unique phases for J things:

Math 7. Table of unique tonal phases for J sensors, (A), (A, B), . . . (A, B, C, D, E)

| J | Sensors | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|---|
| 1 | A | + | − | | | | | | | | | | | | | | |
| 2 | A | + | − | + | − | | | | | | | | | | | | |
| | B | + | + | − | − | | | | | | | | | | | | |
| 3 | A | + | − | + | + | − | − | + | − | | | | | | | | |
| | B | + | + | − | + | − | + | − | − | | | | | | | | |
| | C | + | + | + | − | + | − | − | − | | | | | | | | |
| 4 | A | + | − | + | + | + | − | − | − | + | + | + | − | − | − | + | − |
| | B | + | + | − | + | + | − | + | + | − | − | + | − | − | + | − | − |
| | C | + | + | + | − | + | + | − | + | − | + | − | − | + | − | − | − |
| | D | + | + | + | + | − | + | + | − | + | − | − | + | − | − | − | − |
| 5 | A | + | − | + | + | + | + | − | − | − | − | + | + | + | + | + | + |
| | B | + | + | − | + | + | + | − | + | + | + | − | − | − | + | + | + |
| | C | + | + | + | − | + | + | + | − | + | + | − | + | + | − | − | + |
| | D | + | + | + | + | − | + | + | + | − | + | + | − | + | − | + | − |
| | E | + | + | + | + | + | − | + | + | + | − | + | + | − | + | − | − |

Math 7 shows one embodiment of unique phases for sensors with J=1, 2, 3, 4 & 5, indicated by the letters A to E. The first column begins with all "+" values, indicating that the terminal connections of all the sensors set phases of all the sensors to align with the output. A "−" value indicates a reversed phase, achieved by reversing the terminals of the individual sensor within the circuit. This affects the spectral density of tones at the output of the circuit, since some tones will at least partially cancel out, and others will at least partially add in signal strength.

If one looks closely, one can see that the pattern of terminal switching follows the combinations of J sensors taken L at a time. The first column is J things taken 0 at a time, or all "+". The next column is J sensors taken 1 at a time, or J different terminal reversals, as the "−" value moves down the column. The next column shows J sensors taken 2 at a time, as a pair of "−" values moves down the column. And so on. Note the sequence of moves. It is clear visually, but less easy to describe. The sequence stops just before the very next column is the reverse of the one before it. That is the same as reversing the output terminals of the entire circuit, which causes a phase difference which we reasonably supposed that the human ear cannot detect. In each case for J sensors, the number of possible sign reversals is $2^{J-1}$.

If J is odd, then the combinations of sign reversals are satisfied by J sensors taken i at a time, for i=0 to (J-1)/2. J taken 0 at a time is 1, or the first column of all "+". If J=2, there is only the first column (+,+) and a second column, either (−,+) or (+,−). If J is even and greater than 2, it's more complicated. First the combinations (columns) extend from J sensors taken i at a time, for i=0 to (J-2)/2. Then the combinations of J sensors taken ((J-2)/2+1) at a time, to the limit of the number of combinations of {(J-1) taken ((J-2)/2) times}. So, for the example of J=6, the combinations are 1 set of (6 taken 0 at a time), then 6 sets of (6 taken 1 at a time), then 15 sets of (6 taken 2 at a time), then finally {5 taken 2 at a time} sets of (6 taken 3 at a time). There is even a mathematical expression for this, Math 8a, which shows how the combinations relate to $2^{J-1}$.

Math 8a $$J \text{ odd: } 2^{J-1} = \sum_{i=0}^{(J-1)/2} \binom{J}{i}$$

$$J \text{ even: } 2^{J-1} = \sum_{i=0}^{(J-2)/2} \binom{J}{i} + \binom{J-1}{(J-2)/2}$$

Math 8b $$J \text{ odd: } 2^{J-1} = \sum_{i=0}^{(J-1)/2} \binom{J}{i}$$

$$J \text{ even: } 2^{J-1} = \sum_{i=0}^{(J-2)/2} \binom{J}{i} + \binom{J-1}{(J-2)/2}.$$

Note that past the vertical lines for each set of J sensors, every column to the right is the negative of the column to the left, reflected about the vertical line, making that set of phases duplicates to the human ear. Therefore, we can surmise without further example, that for J sensors, there are $2^{J-1}$ possible unique tonal phases. We can extend this to the basic serial and parallel topologies in any given topology. In each basic topology of size Ji, with i=1 to n such that $J_1+J_2+\ldots+Jn=J$, the sensors in the size Ji basic topology can have $2^{Ji-1}$ unique tonal phases, and that change the phase of each of the n basic topologies together can have $2^{n-1}$ unique tonal phases. Math 9a shows that the product of all these separate changes of phase equals $2^{J-1}$.

$$2^{J_1-1}*2^{J_2-1}*\ldots*2^{Jn-1}*2^{n-1}=2^{J_1+J_2+\ldots+Jn-n}*2^{n-1}=2^{J-n+n-1}=2^{J-1}$$

Math 9a.

Math 9b. Phase changes for subcategory (3 + 2) made of basic series/parallel topologies (3) and (2) for J = 5

| | | | | | | | | | | | | | | | | | |
|---|---|---|---|---|---|---|---|---|---|---|---|---|---|---|---|---|---|
| (3) | A | + | + | + | + | − | − | − | − | + | + | + | + | + | + | + | + |
| | B | + | + | + | + | + | + | + | + | − | − | − | − | + | + | + | + |
| | C | + | + | + | + | + | + | + | + | + | + | + | + | − | − | − | − |
| (2) | D | + | − | + | − | + | − | + | − | + | + | − | − | + | − | + | − |
| | E | + | + | − | − | + | + | − | − | + | − | + | − | + | + | − | − |

Math 9b shows an embodiment for how this works for $J_1=3$ and $J_2=2$, using the letters A to E to identify sensors. In the bottom rows for $J_2=2$, sensors D & E go through the $2^{2-1}=2$ changes, then the inverse of those changes to show the (2) basic topology itself being inverted. Since there are only 2 basic topologies (3) and (2), producing $2^{2-1}=2$ phase changes at the basic topology level, only basic topology (2) has to be inverted. In this case, D+E→(−,+) is not the same as D+E→(+,−), because the ear has the signal from A, B & C as a reference, Basic topology (3) cycles through the phase changes indicated in Math 7 for J=3. This demonstrates 16 unique phases, confirming that this method agrees with $2^{J-1}=2^4=16$. By induction, the maximum number of tonally unique phases for J sensors, $N_{SGN}$ is:

$$N_{SGN}=2^{J-1} \qquad \text{Math 10.}$$

Collecting Categories, Versions, Combinations and Phases

Math 11 shows the characteristics of the topologies of size J discussed so far, where Cs is the number of subcategories, $J_V$ is the cumulative number of versions of topologies for all subcategories, $J_T$ is the resulting total of unique combinatorial topologies, and $N_{SGN}$ is the number of unique phases. The values for J=7 are estimates.

Math 11.

| J | $C_S$ | $J_V$ | $J_T$ | $N_{SGN}$ | $J_T * N_{SGN}$ |
|---|---|---|---|---|---|
| 1 | 1 | 1 | 1 | 1 | 1 |
| 2 | 1 | 2 | 2 | 2 | 4 |
| 3 | 2 | 4 | 8 | 4 | 32 |
| 4 | 4 | 10 | 58 | 8 | 464 |
| 5 | 6 | 24 | 502 | 16 | 8032 |
| 6 | 10 | 72 | 7219 | 32 | 231,008 |
| 7 | 14* | 148* | 43,372* | 64 | 2,775,808* |

*estimated

Let $K_{JT}$ be the total number of possibly distinct tonal combinations for K single coil pickups, or single sensors, taken J at a time. And let $K_T$ be the total number of possibly distinct tonal combinations for K such pickups for all numbers of J. Math 12a shows the appropriate calculations. Recall the table of combinations in Math 1b. The inner cells of Math 12b show the values of $K_{JT}$, while the column on the right shows the sum $K_T$.

$$K_{JT}=\binom{K}{J}*N_{SGN}*J_T=\binom{K}{J}*2^{J-1}*J_T \qquad \text{Math 12a}$$

$$K_T=\sum_{J=1}^{K}K_{JT}=\sum_{J=1}^{K}\binom{K}{J}*2^{J-1}*J_T.$$

Math 12b. Total number of possibly unique tones from K sensors taken J at a time, with sums KT across all possible J ≤ K.

| J | 1 | 2 | 3 | 4 | 5 | 6 | |
|---|---|---|---|---|---|---|---|
| $J_V$ | 1 | 2 | 4 | 10 | 24 | 72 | |
| $J_T$ | 1 | 2 | 8 | 58 | 502 | 7219 | |
| $N_{SGN}$ | 1 | 2 | 4 | 8 | 16 | 32 | |
| $J_T * N_{SGN}$ | 1 | 4 | 32 | 464 | 8032 | 231008 | |
| K | | | | | | | $K_T$ |
| 1 | 1 | | | | | | 1 |
| 2 | 2 | 4 | | | | | 6 |
| 3 | 3 | 12 | 32 | | | | 47 |
| 4 | 4 | 24 | 128 | 464 | | | 620 |
| 5 | 5 | 40 | 320 | 2320 | 8032 | | 10717 |
| 6 | 6 | 60 | 640 | 6960 | 48192 | 231008 | 286866 |
| 7 | 7 | 84 | 1120 | 16240 | 168672 | 1617056 | 1803179 |
| 8 | 8 | 112 | 1792 | 32480 | 449792 | 6468224 | 6952408 |
| 9 | 9 | 144 | 2688 | 58464 | 1012032 | 19404672 | 20478009 |
| 10 | 10 | 180 | 3840 | 97440 | 2024064 | 48511680 | 50637214 |

The standard 6-string electric guitar has about 7 inches (178 mm) between the bridge and the bottom of the neck, which would allow for a maximum of about 8 or 9 standard single-coil electromagnetic pickups with end wires. Consider what the maximum difference in tones might be by taking a pickup at the bridge of a guitar, and adding it out of phase to the signal from a pickup closer to the neck, or for any combination of pickups. Now compare that brightest of tones to the warmest of tones obtained by summing all of the signals of all of the pickups together. For 8 pickups, taken in topologies of J=1 to 6 at a time, there are a possible 6,979,286 tones in between the brightest and warmest.

For 5 separated pickups, there are a possible 11,197 tone circuits. For the 5 coils of two humbuckers and a single, there are less, due to the fact that the coils in a humbucker sit next to each other and share a single magnetic field. The $32^{nd}$ harmonic of a string fundamental on a 25.5 inch base length (top of the neck to the bridge), and the $16^{th}$ harmonic of the same string held at fret 12 is about 0.80 inch, roughly the distance between the two poles of a humbucker pickup.

Not only will the magnetic fields of 8 pickups likely be entangled producing transformer effects between them, and likely similar tones, the adjacent separation of those nearly 7 million tones will likely be mostly indistinguishable to the human ear. What's more, only a few percent of those tones will be humbucking, as we shall see below. To a lesser extent, this may also be true of the possibly unique 11,197 tones of just 5 pickups, taken 1 to 5 at a time. As noted before, this may make more sense with non-fingered stringed instruments like pianos, where the whole length of any string can be used to generate electronic tones from pickups.

Note that if the sensors are single-coil electromagnetic pickups, Math 12 does not assume that any of the pickups are in any way equivalent in response to hum or string vibration. We shall see below that requiring that any of the sensors or their combinations be either matched or humbucking reduces these numbers significantly.

Unique Tonal Combinations of KK Humbucking Pickups Taken JJ at a Time

Figure 4:
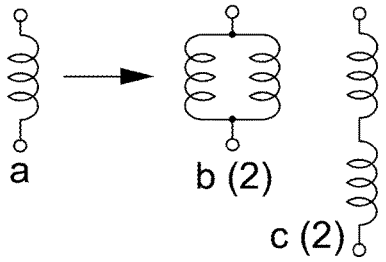
FIG. 4 shows how single-coil electromagnetic pickups are replaced in sensor topologies by dual-coil humbucking pickups, as two versions of subcategory (2) sensors, with the humbucker internal coils connected in parallel, FIG. 4*b*, and in series, FIG. 4*c*.

If one considers using only humbucking electromagnetic pickups, without combining single coils from different humbuckers, it is possible to use the same topologies developed above, replacing each sensor or single coil pickup with a dual-coil humbucker, as in FIG. 4, where the humbucker coils may be connected in parallel (FIG. 4-*b*(2)) or series (FIG. 4-*c*(2)), but the equations have to be modified. The total number of sub-topologies, $JJ_T=J_T$, since the single-coil pickups are replaced by dual-coil humbuckers in the same topologies and subcategories. The individual coils in each humbucker can be connected either in series or parallel, giving 2 choices of sub-combination for each humbucker, as expressed in Math 13a. Math 12a-b then becomes Math 13b & 14.

$$JJ_{SP} = 2^{JJ} \quad \text{Math 13a}$$

$$KK_{JJT} = \binom{KK}{JJ} * 2^{JJ-1} * 2^{JJ} * -JJ_T,\ KK \geq JJ \quad \text{Math 13b}$$

$$KK_T = \sum_{JJ=1}^{KK} KK_{JJT} = \sum_{JJ=1}^{KK} \binom{KK}{JJ} * 2^{JJ-1} * 2^{JJ} * JJ_T.$$

Math 14. Total number of possibly unique tones from KK humbuckers taken JJ at a time, with sums KKT across all possible JJ ≤ KK.

| $N_{SGN} * N_{SP} * JJ_T$ | 2 | 16 | 256 | 7424 | 257029 | |
|---|---|---|---|---|---|---|
| $JJ_T$ | 1 | 2 | 8 | 58 | 502 | |
| $N_{SP}$ | 2 | 4 | 8 | 16 | 32 | |
| $N_{SGN}$ | 1 | 2 | 4 | 8 | 16 | |
| JJ | 1 | 2 | 3 | 4 | 5 | |
| KK | | | | | | KKT |
| 1 | 2 | | | | | 2 |
| 2 | 4 | 16 | | | | 20 |
| 3 | 6 | 48 | 256 | | | 310 |
| 4 | 8 | 96 | 1024 | 7424 | | 8552 |
| 5 | 10 | 160 | 2560 | 37120 | 257029 | 296879 |

Compare the $KK_T$ results in Math 14 with current and past commercial entries. The standard dual humbucker guitar has a 3-way switch, when with a few more switches, it could have up to 20 tonal outputs. The Fender Marauder (Fender, U.S. Pat. No. 3,290,424, 1966) used four single-coil pickups, each about the size of a mini-humbucker with two lines of poles. It had 80 tonal outputs, of which only 48 were unique, and only 8 were unique and humbucking. With four mini-humbuckers, it could have had 8552 possibly unique humbucking tones. The Music Man "St. Vincent" guitar has three humbuckers and a 5-way switch, when it could have 310 humbucking outputs. The Music Man "Game Changer" will be discussed below. Again this begs the question of how many tones are usable, something which can be determined only by experiment and measurement.

A Dual-Humbucker Experiment

Figure 5:
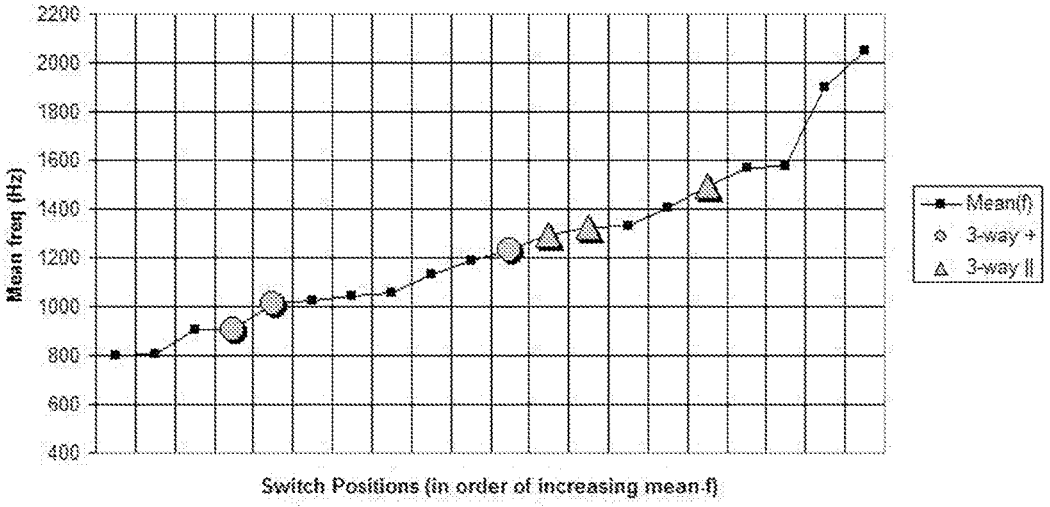
FIG. 5 shows the measured mean-frequencies for an experiment using manual strumming of the strings, a 20-way mechanical switching system, with 24 total switch positions, for a guitar with 2 humbucking pickups, using FFT spectral analyses of the tonal outputs, which are ordered by increasing mean-frequency for each of the 20 switch positions with potentially different tonal outputs, with data points marked for equivalent outputs of a 3-way switching system for the same pickups, with internal coils connected both in series, "+"-circles, and both in parallel, "‖"-triangles.

FIG. 5 shows the results of an experimental test of a prototype guitar with two Hofner-style mini-humbuckers and a 20-way switching network, based upon Math 13a&b & 14 for KK=2. The humbuckers were mounted as near as possible to the neck and bridge of a modified electric guitar. At each switch position, all six strings were slowly strummed 6 times, midway between the humbuckers. The first strum was unfretted, fret 0; the second on fret 1, successively up to fret 5. This was done to produce a wider and smoother range of spectral output.

A desktop computer microphone input received the guitar output. FFT software, SpecAn_3v97c.exe, Simple Audio Spectrum Analyzer v3.9 ©W.A. Steer 2001-2016, accumulated the audio data and produced an FFT amplitude spectrum. The software was set to: Amplitude scale=135 dBFS; zero-weighted; Freq scale=log; Visualize=Spectrograph w/avg; Sample rate=44.1 kHz; FFT size=4096; FFT window=Hann cosine. The audio volume pot on the guitar was set to avoid clipping. Each FFT spectral average was exported to a text file with a *.csv suffix filename, then imported into an MS Excel spreadsheet.

In the spreadsheet, each import file produced 2048 frequency "buckets", from 0 to 21,039 Hz, with an average value in dB for each amplitude and a frequency resolution of about 10.7 Hz. Math 15 shows how the data was processed to obtain the $1^{st}$, $2^{nd}$ & $3^{rd}$ frequency distribution moments. The average spectral amplitude was converted from log to linear voltage, $linV_n$, n going from 1 to 2048. From this a frequency spectral density function, $P_V(f_n)$ was constructed by dividing each value of linV by the sum of the values. The $1^{st}$ moment, or mean frequency, mean·f, was then the sum of the product of $f_n$ times $P_V(f_n)$. The second moment is the sum of the product of $(f_n\text{–mean·f})^2$ times the spectral density. And the $3^{rd}$ moment is the sum of the cube of $(f_n\text{–mean·f})$ times the spectral density. Only mean·f is plotted in FIG. 5, ordered by increasing mean·f.

$$linV_n(f_n) = 10^{dBFS_n/20},\ 1 \leq n \leq 2048 \quad \text{Math 15}$$

$$P_V(f_n) = \frac{linV_n}{\sum_{n=1}^{2048} linV_n}$$

$$mean.f = \sum_{n=1}^{2048} f_n * P_V(f_n)$$

$$2nd.moment.f = \sum_{n=1}^{2048} (f_n - mean.f)^2 * P_V(f_n)$$

$$3rd.moment.f = \sum_{n=1}^{2048} (f_n - mean.f)^3 * P_V(f_n).$$

The differences in frequency between adjacent values of mean frequency run from 0.44 Hz to 326.5 Hz, with an average difference of 65.9 Hz and a standard deviation of 75.8. The smallest differences, less than the resolution of the FFT, occur at 7.5 Hz between points 1&2, 0.44 Hz between 3 & 4, 9.0 Hz between 13 & 14, and 0.51 Hz between 17 & 18. The three largest differences are 102.1 Hz between points 4 & 5, 326.5 Hz between 18 & 19, and 154.0 Hz between 19 & 20. Removing these points changes the mean difference to 54.3 Hz with a standard deviation of 29.5. If one removes the 4 points with the smallest difference to the one above it, one could argue that there are only 16 effectively different tones, out of a 20-way switching system with 24 switch positions. But at least they are all humbucking.

Six data points in the plot correspond to a 3-way switch, 3 designated by circles for 2 humbuckers with their internal coils connected together in series, and 3 by triangles for 2 humbuckers with their internal coils connected together in parallel. Often, the bridge humbucker may be "hotter", with a stronger signal output, than the neck humbucker, because of the smaller relative motion of the strings near the bridge.

The humbuckers used here had equal outputs, which may account for the bunching together of two circles and two triangles in the lower range of each.

Note that the mean frequencies seem much larger than one might expect from the octave range of a guitar. This may be explained by the method of the experiment. The FFT measurement range went to 22 kHz, far above the octave range of a guitar, introducing noise as well as guitar output. Strumming over six frets to produce as wide as possible a range of frequencies, with a frequency resolution of 10.7 Hz would also have broadened any spectral peaks of fundamentals and harmonics. If the frequency resolution had instead been 1 Hz, and only one string strummed on one fret, the spectral peaks would have been sharper and the mean frequencies much lower, as confirmed by later experiment. So the results can only be taken to demonstrate that the 20-way switching circuit has relatively wider range and finer tonal distinctions than a 3-way switching circuit.

Note: In the case of humbuckers, since individual coils within each humbucker are matched in turns to each other, the number of turns from humbucker to humbucker do not have to be matched in the $KK_{JJT}$ combinations shown in Math 14 for the whole to remain humbucking. The practical limits for how many pickups, single-coil or humbucker, can be placed along the strings is limited for most electric guitars, but not pianos, to the space between the bridge and neck. Besides which, the closer individual coils come to each other in space, the more their fields interact, and transfer vibrational energy between them, causing tonal and phase effects which cannot be addressed here.

Humbucking Pairs, Quads, Hexes, Octets, Etc.

Baker (U.S. Pat. No. 9,401,134, 2016) developed the concept of humbucking pairs. This patent extends the concept to humbucking pairs, quads and octets by methods that can be applied to higher orders. Coils now represent pickup sensors in the Figures, to represent electromagnetic coil guitar pickups, because, other than perhaps electromagnetic coil microphones and hall-effect sensors, sensors such as piezoelectric, optical, capacitive proximity and capacitive microphone sensors do not respond in the same way to low-frequency external magnetic fields, or "hum". The patent applied to pairs of K number of single-coil pickups, all with matched numbers of turns in their coils, and equally responsive to a uniform external hum field.

There may be some tradeoff between the number of coil turns and the size and configuration of the pole pieces, so for this discussion the "matched pickups" are assumed to be clones. For if the number of turns or size of wire changes the resistance and inductance of the coil can change, and between dissimilar pickups, the difference in phases will mean that a dissimilar pair, even if responding equally to one frequency of external hum, will not be exactly in-phase or contra-phase over the whole range of string frequencies. To recap, two single-coil pickups connected together, in series or parallel, can only be humbucking if when they have different magnetic poles up, or towards the strings, they are connected in-phase. If they have the same magnetic pole up, they must be connected out-of-phase, or contra-phase, to be humbucking.

The math changes with humbucking pairs, quads, hexes, octets and up. Because pickups are paired together and only the pairs can reverse connections together, the calculation of phases changes. The issue of symmetry, where circuit topologies are symmetrical both left-right and up-down, has an effect. Because the pickups are all clones, except for the direction of magnetic field, any pickup can be placed at any position in a symmetrical topology and produce the same signal at the output when it has the same phase with respect to the output. In the net result, humbucking pairs connected so that an entire topology of size J has a humbucking output have far fewer possible outputs for the same number of pickups as non-humbucking topologies, typically one or more orders of magnitude less. Yet the numbers are still potentially much larger than current 3-way and S-way switches can produce.

It is also possible to use humbucking pairs where the pickups in each pair are clones and the pickups between pairs are not. Because the matched pickups have to be kept together, either in series or parallel pairs, this would reduce the number of potentially unique outputs compared to those of sets of different dual-coil humbuckers.

Humbucking Pairs

Consider again FIG. 4, the same topology in a different light. FIG. 4*a* shows a single single-coil pickup. In FIG. 4*b*, a humbucking pair of single-coil pickups replaces it, connected in parallel. In FIG. 4*c*, they are connected in series. Let the number of humbucking pairs be JP=1. As with the single pickup in FIG. 4*a*, changing the output connections of a pair to present an inverted signal to the output will not produce a tonal difference that the human ear can hear. So the number of choices for the sign, or inversion, of the output of a single humbucking pair is $N_{SGN\text{-}HP}=2^{JP}=1$, as illustrated in Math 10 for J=1. The number of topologies of humbucking pairs is $N_{T\text{-}HP}=2$.

For reasons which will become apparent, the serial-parallel multiplier, $JJ_{SP}$, is not used as it was for humbucking pairs as it was for dual-coil humbuckers in Math 13ab and Math 14. Math 16 shows the number of combinations of humbucking pairs, $K_{CP}$, for K things taken 2 at a time for both versions of subcategory (2) topologies in FIG. 4*b*&*c*.

$$K_{CP} = \binom{K}{2} * N_{T-HP} * N_{SGN-HP} = \frac{K*(K-1)}{2*1} * 2 * 2^{JP-1} = \frac{K*(K-1)}{2*1} * 2 * 1 = K*(K-1),\ K \geq 2 \qquad \text{Math 16}$$

*i.e.*, For $K = 2, 3, 4, 5, 6, 7, 8$; $K_{CP} = 2, 6, 12, 20, 30, 42, 56$.

Humbucking Quads

Two humbucking pairs, JP=2, connected together to form one topology with two output wires, makes a humbucking quad. FIG. 6*a*&*b* show single-coil pickups in series and parallel, respectively. FIGS. 6*c*-*h* show tonal topology variations on series-connected and parallel-connected humbucking pairs, with subcategories (2+2) and (4). For example, FIGS. 6*c* & 6*d* show those single-coil pickups replaced by parallel-connected humbucking pairs. FIG. 6*c* is labeled as category 4 because of symmetry, which will be explained. FIGS. 6*f* & 6*h* show the coils in FIGS. 6*a* & 6*b* replaced by two coils in series. FIGS. 6*e* & 6*g* show one each of a series and parallel pair replacing the single coils in FIG. 6*a*&*b*. Of which there can only be one each because swapping the series and parallel pairs in either FIG. 6*e* or 6*g* would not provide a different output, due to merely changing the order of the pair in the topology.

Here we have assumed that series and parallel combinations of the same two pickups will produce different tonal outputs. That may not always be true in practice. The tonal difference between parallel and series connected pairs derives from the low-pass or low-pass/peak filter created when the pairs are connected to a resistive or capacitive load. When series and parallel pairs are connected to a high-impedance load, the differences in tone are far higher in frequency than human hearing.

It is also possible that in some circumstances, topologies like FIG. 6*c* can be electrically equivalent to topologies like FIG. 6*h*, obtained by merely splitting a connection. In which case, it could be more accurate to refer to all the output for humbucking topologies as "potentially unique". Besides which, the experiment with 20-way switching of dual humbuckers above shows that some outputs can be very close together in tone, without any apparent explanation. The proof is in experiment and measurement.

Figure 6:
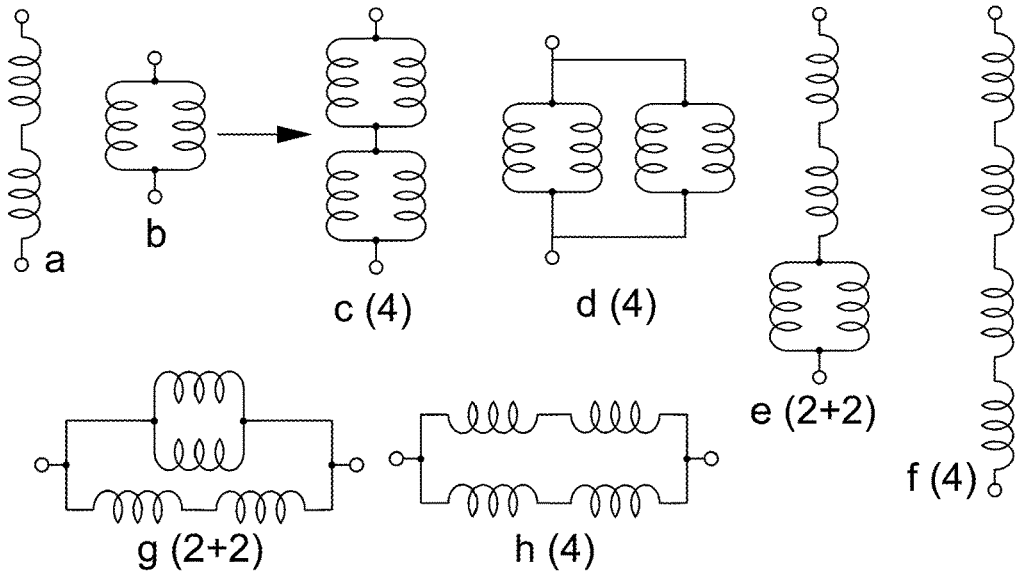
FIG. 6, to develop the concept of humbucking quads, shows how a set of circuit topologies of two pairs, or quads, of sensors are created by replacing each of the single sensors in the categories (2) topologies with pairs of sensors in serial and parallel, so as to produce the maximum number of topologies of potentially different tonal outputs, with subcategories (4) and (2+2).
Figure 7:
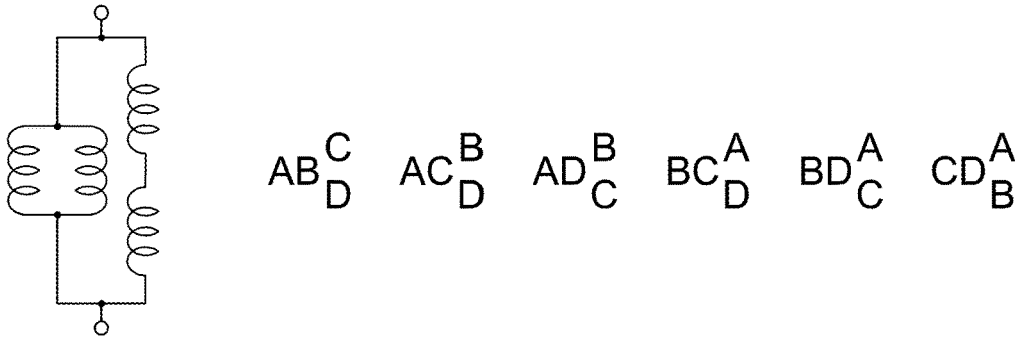
FIG. 7, using pickups labeled A, B, C & D, shows how the topology in FIG. 6*g* can produce six potentially different sub-combinations, or versions, of paired pickups of topological category (2+2), because of combinatorial calculations of 4 thing taken 2 at a time, times 2 things taken 2 at a time.

As shown in FIG. 7 for FIG. 6*g*, the (2+2) category is combinations of 4 things taken 2 at a time, times 2 things taken 2 at a time, or 6 sub-combinations for that category. For the (2+2) topological categories, Math 7 & 10 also apply, with $N_{SGN-HP}=2$, producing 12 potentially distinct tonal outputs. The same is true for the other (2+2) category, FIG. 6*e*.

Figure 8:
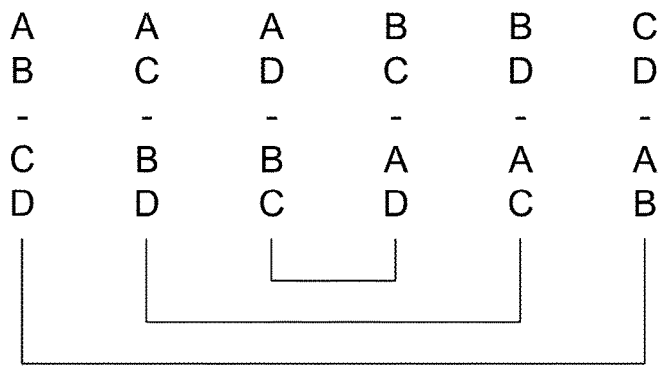
FIG. 8 shows how the symmetry of a category (4) circuit topology, like FIG. 6*f*(4), reduces the number of possible unique versions, grouped as two pairs of sensors, to consider the effects of reversing the connections of one pair, from 6 to 3.

All category (4) topologies have up-down, left-right symmetry, and circuit theory shows that exchanging the position of any pickup with any other cannot change the signal at the terminals of the topology. FIG. 8 shows the sub-combination expansion of FIG. 6*f*, similar to FIG. 7. Since the order of pairs in the topology does not matter, its up-down, left-right symmetry reduces the number of possibly distinct tonal sub-combinations, disregarding signs, from 6 to 3. But we must take into account the phase signs introduced by humbucking in-phase and contra-phase pairs. Suppose that we have pickups A, B, C and D, where all have the north pole up. All pairs must then be contra-phase, with respect to string vibrations, to be humbucking. The lower-case letters, a, b, c and d, represent the respective amplitudes of signals from each of the pickups that show in the output. Because all humbucking pair outputs are contra-phase, 2 signals will have + signs and 2 will have − signs. Math 17 shows all three combinations on the left side of FIG. 8, and the cases where the output of the upper pair is inverted. Characterizing each output by the signal which has the same sign as signal "a", we can see that there still only 3 distinct tonal outputs when both pairs and signs are considered. The others are duplicates.

Math 17. Table of pair and sign combinations for four pickups in series or parallel

| (AB, CD) | | (−AB, CD) | | (AC, BD) | | (−AC, BD) | | (AD, BC) | | (−AD, BC) | |
|---|---|---|---|---|---|---|---|---|---|---|---|
| A | a | −A | −a | A | a | −A | −a | A | a | −A | −a |
| B | −b | −B | b | C | −c | −C | c | D | −d | −D | d |
| C | c | C | c | B | b | B | b | B | b | B | b |
| D | −d | D | −d | D | −d | D | −d | C | −c | C | −c |
| | a | | a | | a | | a | | a | | a |
| | c | | d | | b | | d | | b | | c |
| dups | 1 | | 2 | | 3 | | 2 | | 3 | | 1 |

Consider this, if there are only 2 + signs and 2 − signs for the signal outputs, then there are only 3 choices of signal, b, c & d, to have the same sign as signal "a". The duplicate pairs are (AB,CD) & (−AD,BC), (−AB,CD) & (−AC,BD), and (AC,BD) & (AD,BC). Choose any one of each for the three potentially unique tones.

What if not all the same poles are up? Math 18 shows the results for pickup A with the south pole up, as designated by the underscore, A. Any of the remaining north-up coils must be in-phase with A, with respect to string vibrations, to be humbucking. Here again, we characterize the sub-combinations by picking all the signal with the same sign as "a". There are only 3; the in-phase pairs designated by signals a-b, a-c & a-d, with the remaining pair connected contra-phase. We can offer the conjecture, without proof, that this will be true of any number of north and south poles up. The others are duplicates. In this case, the duplicate pairs are (AB,CD) & (AC,BD), (−AB,CD) & (AD,BC), and (−AC, BD) & (−AD,BC). So for this kind of analysis, a category (4) topology is considered one entity with 3 phase versions, setting $N_{SGN-HP}$ or $N_{SGN-HQ}=1$.

Math 18. Table of pair and sign combinations for four pickups in series or parallel

| (AB, CD) | | (−AB, CD) | | (AC, BD) | | (−AC, BD) | | (AD, BC) | | (−AD, BC) | |
|---|---|---|---|---|---|---|---|---|---|---|---|
| A | a | −A | −a | A | a | −A | −a | A | a | −A | −a |
| B | b | −B | −b | C | c | −C | −c | D | d | −D | −d |
| C | c | C | c | B | b | B | b | B | b | B | b |
| D | −d | D | −d | D | −d | D | −d | C | −c | C | −c |
| | a | | a | | a | | a | | a | | a |
| | b | | b | | b | | c | | b | | c |
| | c | | d | | c | | d | | d | | d |
| dups | 1 | | 2 | | 1 | | 3 | | 2 | | 3 |

One might question whether or not contra-phase can ever be the same as reversing output connections on a humbucking pair. Consider six matched single-coil pickups A, B, C, D, E and F, where A and C have south poles up and the other four have north poles up. Math 19 shows that even if C had the same signal as E and D the same signal as F, the four different connections produce four different sums. So reversing the output connections of a contra-phase humbucking pair cannot make it in-phase with the other pairs.

$$\underline{A}B \rightarrow a+b; \underline{C}D \rightarrow c+d; EF \rightarrow e-f$$

$$\underline{A}B+\underline{C}D \rightarrow a+b+c+d; \underline{A}B-\underline{C}D \rightarrow a+b-c-d$$

$$\underline{A}B+EF \rightarrow a+b+e-f; \underline{A}B-EF \rightarrow a+b-e-f \qquad \text{Math 19.}$$

The (2+2) category can be calculated by ordinary combinatorial math and $N_{SGN-HP}=2^{JP-1}=2^{2-1}=2$, as shown in Math 20. By this math, the total number of tonal topologies for humbucking quads, $N_{T-HQ}=48$, and the total number of humbucking quads for K≥4, $K_{CQ}$, is 48 times K things taken 4 at a time. Note that any switching system using 4 matched single-coil pickups, either in series or parallel, will have to map and identify each set of three distinct humbucking tonal combinations of pairs and signs. This will require knowing which poles are up on which pickups. Note that if FIG. 6*c*&*h* are equivalent, FIG. 6 shows only 3 different topologies of category (4), with 2 topologies of category (2+2), setting $N_{T-HQ}=33$. But we are not making that decision now, leaving it to be determined by experiment and measurement.

Math 20

$$(4):\ 4*\left[\binom{4}{4}*3(\text{with pairs \& sign})\right]*N_{SGN-HP} = 4*[1*3]*1 = 12$$

$$(2+2):\ 2*\binom{4}{2}*\binom{2}{2}*N_{SGN-HP} = 2*6*1*2 = 24$$

$$N_{T-HQ} = 12+24 = 36$$

$$K_{CQ} = \binom{K}{4}*N_{T-HQ} = \binom{K}{4}*36,\ K \geq 4$$

-continued $$\text{for } K = 4, 5, 6, 7, 8; \binom{K}{4} = 1, 5, 15, 35, 70;$$

$$K_{CQ} = 36, 180, 540, 1260, 2520.$$

To check the math for K=5, consider Math 21, which show an additional $5^{th}$ pickup, E, in each position for A, B, C & D. This produces (5 things taken 4 at a time) times (4 versions of (4)) times (3 pairs&signs)=60 potentially unique tones. Using combinatorial math for the (2+2) category topologies, it is (5 things taken 2 at a time) times (2 topological versions) times (3 things taken 2 at a time) times ($N_{SGN-HP}$=2). Math 22 shows the confirming calculations.

Math 21. Table of substitutions for adding pickup E to A, B, C & D, 5 things taken 4 at a time.

| | | | | |
|---|---|---|---|---|
| A | E | A | A | A |
| B | B | E | B | B |
| C | C | C | E | C |
| D | D | D | D | E |

Math 22

$$(4): \binom{5}{4} * 4 * 3(\text{with pairs \& signs}) = 60, K = 5$$

$$(2+2): \binom{5}{2} * 2 * \binom{3}{2} * N_{SGN-HP} = 10 * 2 * 3 * 2 = 120$$

$$60 + 120 = 180$$

$$K_{CQ} = \binom{5}{4} * N_{T-HQ} = 5 * 36 = 180.$$

For K=5 matched pickups, Math 23 shows the number of possibly tonally different humbucking pairs and quads is 200. For two humbuckers and one single-coil pickup, as in the Music Man "Game Changer" guitar, even if the single-coil pickup is matched to each of the coils of the humbuckers, this may diminished by the fact that the coils in the humbuckers are so close together and have the same field, and some number of pair and quad combinations will produce essentially duplicate tones. And note that of the 11,197 potentially different tonal combinations of 5 pickups that are possible in Math 12b, only 200, or about 1.79% may be humbucking, if and only if the coils are matched. Compare this to the Fender Marauder, which had a "noisy" reputation and failed in the market, of which 16 of 80 outputs, or 20%, were potentially humbucking, and half of those duplicates. This illustrates the importance of accurately assessing connections with humbucking outputs.

Math 23

$$\text{For } K = 5, K_{CP} + K_{CQ} = K * (K - 1) + \binom{K}{4} * N_{T-HQ}$$

$$= 5 * 4 + \binom{K}{4} * 36 = 20 + 180 = 200.$$

The Limits of Theory

It's all very well to say that FIG. 6*c*&*h* are electronically equivalent for matched coils. But the theory does not take account of factors such as goodness of match due to manufacturing practice and the interaction of electromagnetic fields. In the results for the experiment shown in FIG. 5, with two very similar Hofner-style humbuckers, one at the neck and one at the bridge, as discussed in the section on "Unique tonal combinations of KK humbucking pickups . . . ", the measured mean frequencies, mean·f, for the equivalents of FIG. 6*c*&*h* are not equal, as shown in Math 24. The equivalent of FIG. 6*c* shows mean·f=1056.8 Hz for the humbuckers in-phase with each other, and mean·f=1571.5 Hz for out-of-phase. The FIG. 6*h* equivalent for both humbuckers in phase shows a mean·f=1009.4 Hz for the humbuckers in-phase, and 1408.3 Hz for out-of-phase. The mean·f=1009.4 Hz & 1056.8 Hz for in-phase and out-of-phase humbuckers may seem close, but in between them are 2 more points at mean·f=1025.7 and 1040.8 Hz.

The connections corresponding to FIG. 6*e* and the neck humbucker alone with coils in series, FIG. 6*a*, produce mean·f=907 Hz. The connections corresponding to FIG. 6*c* with the neck humbucker connections reverse produces mean·f=1571.5 Hz, Those corresponding to FIG. 6*e* with the neck humbucker connected out-of-phase with its coils in parallel and the bridge humbucker coils connected in series produce mean·f=1572.0 Hz. So it would seem that instead of the 20 distinct tonal combinations predicted by Math 13b, 14 & 15, there are only 16 or 17, for reasons not entirely understood.

Math 24. Results with nearly equal mean.f in FIG. 5, for neck, N, and bridge, B, humbuckers.

| Equiv. FIG. | Connections | Mean.f (Hz) | Square-root $2^{nd}$ moment (Hz) | Cube-root $3^{rd}$ moment (Hz) |
|---|---|---|---|---|
| 6a | Ns | 907.4 | 1737.7 | 3182.0 |
| 6c | Np + Bp | 1056.8 | 2026.6 | 3546.9 |
| 6c | (−Np) + Bp | 1571.5 | 2419.8 | 3867.1 |
| 6e | Np + Bs | 906.9 | 1630.2 | 3073.3 |
| 6e | (−Np) + Bs | 1572.0 | 2228.9 | 3720.2 |
| 6h | Ns‖Bs | 1009.4 | 1929.0 | 3410.8 |
| 6h | (−Ns)‖Bs | 1408.3 | 2314.3 | 3829.4 |

P subscript = internal humbucker coils in parallel; S subscript = internal coils in series; + = humbuckers in series; ‖ = humbuckers in parallel For the supposed duplicates in Math 24, according to mean·f, not predicted by the theory above, the square roots of the $2^{nd}$ moments and the cube roots of the $3^{rd}$ moments are not quite equal by 100 to 200 Hz. It would take a musically trained ear to determine if they sound the same or not. Nevertheless, it is better for honest and successful marketing to underestimate the number of distinct tones, and provide a pleasant surprise, than the converse. The only proof of theory is experiment. All possible combinations should be tried before removing those which prove to be tonal duplicates.

Due to this, the preferred implementation of the electronic switching system, to be described below, includes the means to analyze the outputs of all possible switch combinations for humbucking, mean frequency, and the $2^{nd}$ and $3^{rd}$ moments of frequencies of a strummed stringed instrument. This implies and requires that the electronics include software switching control, analog-to-digital conversion, and FFT generation, preferably to 1 Hz resolution from about 10 Hz to 10 kHz.

Humbucking Hexes

FIGS. 9*a-d*, 10*a-f*, 11*a-f* & 12*a-d*, convert the triple-sensor topologies of FIG. 1*c-a*(3) to 1*c-d*(3) into triple humbucking pairs, or humbucking hexes, with sub-combination categories of (2+2+2), (4+2) and (6). Because we are talking about humbucking coil pickups, the circle-sensor symbols in FIG. 1*c* have been replaced with coil symbols.

There are 4 versions of subcategory (2+2+2), 12 of (4+2) and 4 of (6). For the purposes of calculating $N_{SGN-HP}$ in each category, (2+2+2) comprises 3 entities or JP=3, setting $N_{SGN-HP}$=4, (2+4) comprises 2 entities, or JP=2, setting $N_{SGN-HP}$=2, and (6) comprises 1 entity, or JP=1, setting $N_{SGN-HP}$=1.

Figure 9:
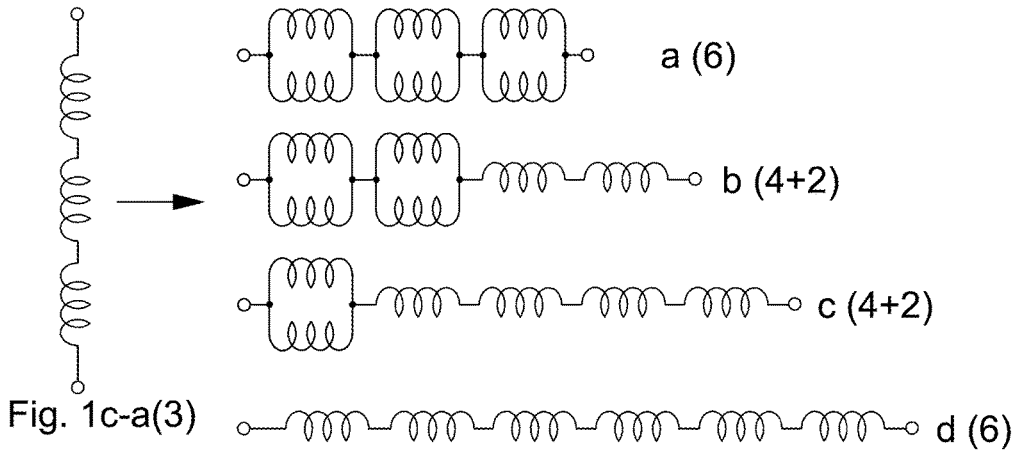
FIG. 9, to develop the concept of humbucking hexes, shows how the single sensors in the three-sensor basic topology of FIG. 1*c-a*(3) are replaced by pairs of sensors in series and parallel to create 2 unique versions of subcategory (6) and 2 unique versions of subcategory (4+2) or (2+4).
Figure 10:
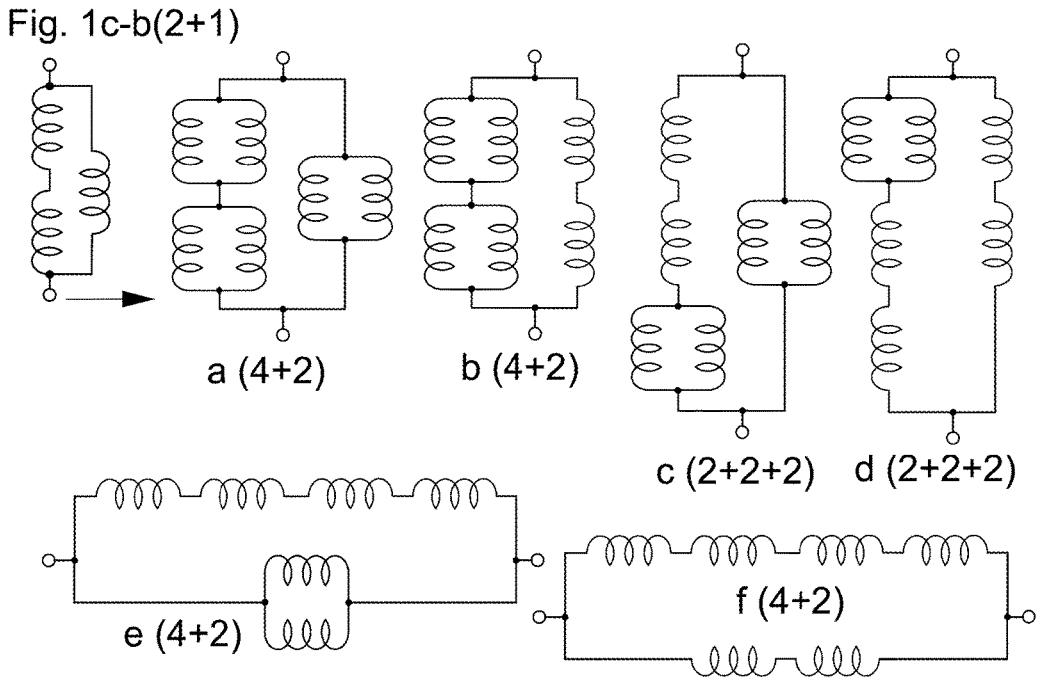
FIG. 10, continuing the development of FIG. 9, shows how 3 single sensors in FIG. 1*c-b*(2+1) can be replaced with series and parallel pairs to create 6 new and different hex topologies, 4 versions of subcategory (4+2) and 2 versions of subcategory (2+2+2). One starts by replacing all the single coils with parallel pairs, then replacing the parallel pairs with series pairs, until all possible combinations or versions are achieved.

To analyze the potential "pairs & signs" of category (6), another topology of left-right, up-down symmetry, consider the single-coil pickups A, B, C, D, E and F connected in series, as in FIG. 9*d*. Math 25 shows 15 combinations for the pair choices AB, AC, AD, AE and AF, to create humbucking hex combinations. Note that when the next logical choice of pair combinations, BC, is used, it only generates duplicates of those already chosen, leaving 15 sets of 3 pairs. One can offer the conjecture, without proof, that all other combinations will also be duplicates of the 15 already constructed.

Math 25. Table of combinations and duplicates for 6 matched coils in pairs.

| | | | | | | | | | | | | | | |
|---|---|---|---|---|---|---|---|---|---|---|---|---|---|---|
| AB | AB | AB | AC | AC | AC | AD | AD | AD | AE | AE | AE | AF | AF | AF |
| CD | CE | CF | BD | BE | BF | BC | BE | BF | BC | BD | BF | BC | BD | BE |
| EF | DF | DE | EF | DF | DE | EF | CF | CE | DF | CF | CD | DE | CE | CD |
| | | | | | | BC | | | BC | | | BC | | |
| | | | | | | AD | | | AE | | | AF | | |
| | | | | | | EF | | | DF | | | DE | | |

Suppose that A, B, C, D, E and F are all matched single-coil pickups with north poles up, and a, b, c, d, e and f represent the signal levels in each coil. Then each pair will be contra-phase, i.e., AB will have a signal a-b. That means that will all humbucking hex combinations in Math 25, there will be 3 + signal terms and 3 − signal terms. The outputs of the series hex can then be characterized by the signals with the same sign as signal a.

Math 26 shows the pairs and signs calculations for 4 of the 15 sets in Math 25, following the method of Math 17. For example, we take 6 coils in series as the pairs (AB,CD,EF) and calculate the signs of the signals. Then we reverse the connections of pair AB, i.e., (−AB,CD,EF), and CD and EF in turn to calculate the signs of the signals. So for each of the 15 sets, there might be 4 potentially different tones or a total of 60. Here the sets are distinguished in the bottom 4 rows, according to which signal outputs have the same sign as signal "a" from pickup A, as noted in the bottom row by assigning a number to each new combination, and the same number for each duplicate. Note that for 16 potentially distinct humbucking tonal outputs, half are duplicates.

Math 26. Table of pairs and signs for 4 of 15 sets of combinations

| AB, CD, EF | | | | | | | |
|---|---|---|---|---|---|---|---|
| A | a | −A | −a | A | a | A | a |
| B | −b | −B | b | B | −b | B | −b |
| C | c | C | c | −C | −c | C | c |
| D | −d | D | −d | −D | d | D | −d |
| E | e | E | e | E | e | −E | −e |
| F | −f | F | −f | F | −f | −F | f |
| | a | | a | | a | | a |
| | c | | d | | d | | c |
| | e | | f | | e | | f |
| | 1 | | 2 | | 3 | | 4 |
| **AB, CE, DF** | | | | | | | |
| A | a | −A | −a | A | a | A | a |
| B | −b | −B | b | B | −b | B | −b |
| C | c | C | c | −C | −c | C | c |

-continued

Math 26. Table of pairs and signs for 4 of 15 sets of combinations

| | | | | | | | |
|---|---|---|---|---|---|---|---|
| E | −e | E | −e | −E | e | E | −e |
| D | d | D | d | D | d | −D | −d |
| F | −f | F | −f | F | −f | −F | f |
| | a | | a | | a | | a |
| | c | | e | | d | | c |
| | d | | f | | e | | f |
| | 5 | | 6 | | 3 | | 4 |
| **AB, CF, DE** | | | | | | | |
| A | a | −A | −a | A | a | A | a |
| B | −b | −B | b | B | −b | B | −b |
| C | c | C | c | −C | −c | C | c |
| F | −f | F | −f | −F | f | F | −f |

-continued

Math 26. Table of pairs and signs for 4 of 15 sets of combinations

| | | | | | | | |
|---|---|---|---|---|---|---|---|
| D | d | D | d | D | d | −D | −d |
| E | −e | E | −e | E | −e | −E | e |
| | a | | a | | a | | a |
| | c | | e | | d | | c |
| | d | | f | | f | | e |
| | 5 | | 6 | | 2 | | 1 |
| **AC, BD, EF** | | | | | | | |
| A | a | −A | −a | A | a | A | a |
| C | −c | −C | c | C | −c | C | −c |
| B | b | B | b | −B | −b | B | b |
| D | −d | D | −d | −D | d | D | −d |
| E | e | E | e | E | e | −E | −e |
| F | −f | F | −f | F | −f | −F | f |
| | a | | a | | a | | a |
| | b | | d | | d | | b |
| | e | | f | | e | | f |
| | 7 | | 2 | | 3 | | 8 |

A pattern emerges. If all of the different tonal outputs are characterized by the two signals which have the same sign as signal "a", then there are 5 remaining signals, b, c, d, e and f, taken 2 at a time. Which means that there can only be 10 tonally distinct pair and sign outputs of six coils in series, or in parallel, with the other 4×15−10=50 potential outputs being duplicates. When the full mapping is done, they turn out to be abc, abd, abe, abf, acd, ace, acf, ade, adf, & aef. One can offer the conjecture, without proof, that for any combination of north-up and south-up pole pickups adding up to K=6, there will also be only 10 different pair & sign choices for a category (6) topology.

Math 27 shows the total number of humbucking hex topologies, $N_{T_HH}$, for 4 topology categories of (6), 12 categories of (4+2) and 4 categories of (2+2+2), and thus the total number of possible tonally distinct humbucking hexes, $K_{Ch}$, given K matched single-coil pickups, for K≥6. Again, $N_{SGN-HP}$ is determined by the number of entities which can be connected in reverse to the circuit, 1 for category (6) topologies, 2 for (2+4) and 4 for (2+2+2).

Math 27

$$(6):\ 4*\left[\binom{6}{6}*10(\text{with pairs \& signs})\right]*N_{SGN-HP} = 4*[1*10]*1 = 40$$

$$(2+4):\ 12*\binom{6}{2}*\left[\binom{4}{4}*3(\text{with pairs \& signs})\right]*N_{SGN-HP} = 12*15*[1*3]*2 = 1080$$

$$(2+2+2):\ 4*\binom{6}{2}*\binom{4}{2}*\binom{2}{2}*N_{SGN-HP} = 4*15*6*4 = 1440$$

$$N_{T-HH} = 40 + 1080 + 1440 = 2560$$

$$K_{CH} = \binom{K}{6}*N_{T-HH} = \binom{K}{6}*2560,\ K \geq 6$$

for $K = 6, 7, 8$; $\binom{K}{6} = 1, 7, 28$; $K_{CH} = 2560, 17920, 71680$.

Note the second line of Math 27, for (4+2)=(2+4) subcategories. It doesn't matter which number (4) or (2) is taken first in the calculation, which here takes (2) first to calculate the number of combination of 6 things taken 2 at a time. This leaves a unique set of (4) pickups, or 4 things taken 4 at a time, which has only 3 possible humbucking combinations of those four pickups due to the pairs and signs symmetry. The number of entities, subcategory topologies (4) and (2) in the (4+2) or (2+4), allows for $2^{2-1}$=2 different phases by inverting connections to the whole.

NOTE: A Hofner-style mini-humbucker is about 1.2 inches wide, or about 0.6 inch per coil. Standard single-coil pickups with center connections are about 0.93" wide, and with end connections about 0.72" wide. For a guitar with a nominal base length of 25.5 inches, there are about 5.75 inches of usable pickup mounting space between the neck and bridge. Six matched mini-single-coil pickups of 0.6 inch width will fit in that space with a center-to-center spacing of about 1.03 inches. A 5.75 inch space would be completely filled with about 4.8 mini-humbuckers or at most 8 or 9 redesigned standard single-coil pickups.

According to Math 16, 20 & 27, for K=6, $K_{CP}+K_{CQ}+K_{CH}$=30+540+2560=3130 potentially distinct humbucking tones, or ~1.08% of the 289,746 possible connections of 6 pickups shown in Math 12ab. Less, if some of the topologies turn out to be electrically equivalent, and/or produce the same tones. However, the dual-humbucker experiment cited above indicates that some tones might have such small distinctions between them as to be duplicates, potentially reducing the total. At that pickup spacing, one might also suspect that the pickup electromagnetic fields may interact, potentially smearing such distinctions, further reducing the number of distinct tones.

Humbucking Octets

Humbucking octets are constructed by replacing the single matched sensors in FIG. 2*a*&*b*, a(4) to j(2+2), with series and parallel pairs. Without presenting all the drawings here, Math 28 shows the results for 5 existing topological categories generated from a(4) to j(2+2) singles,: 8 instances of category (8), 12 instances of (2+6), 11 instances of (4+4), 36 instances of (2+2+4), and 11 instances of (2+2+2+2). Note that the symmetry of FIG. 2*b*-*i*(2+2)&*j*(2+2) makes them category (4) in humbucking pairs, and category (8) in humbucking quads.

Math 28. Distinct humbucking tonal categories derived from FIG. 2a & b-a-j

| | a | b | c | d | e | f | g | h | i | j | sums |
|---|---|---|---|---|---|---|---|---|---|---|---|
| (8) | 2 | | | | | | | 2 | 2 | 2 | 8 |
| (6 + 2) | 2 | 4 | | | | | 4 | 2 | | | 12 |
| (4 + 4) | 1 | | | 4 | 4 | | | 1 | | 1 | 11 |
| (4 + 2 + 2) | | 4 | 8 | 4 | 4 | 8 | 4 | | 2 | 2 | 36 |
| (2 + 2 + 2 + 2) | | | 4 | 1 | 1 | 4 | | | 1 | | 11 |
| sums | 5 | 8 | 12 | 9 | 9 | 12 | 8 | 5 | 5 | 5 | 78 |

Recall from Math 10 that 4 pickups, or 4 humbucking pairs, have 8 possible sign combinations. Suppose a series-connected octet of 8 matched single-coil pickups, A, B, C, D, E, F, and H, with respective signals a, b, c, d, e, f, g and h, and all the pickup poles are north up. That means that all the (2+2+2+2) versions of those pickups are contra-phase pairs, with 4 signals with + signs, and 4 signals with − signs. If the same rules hold true as for category (6), one could take signal "a" and choose the seven remaining signals taken 3 at a time. There will be 35 sets of signals, all with the same sign as "a", starting with a+b+c+d and ending with a+e+f+g. Math 29 shows the pattern for a parallel, series or symmetrical topology with a number of matched pickups, Je=4, 6 & 8, with the extension by induction to Je=10, with a conjecture for the number of humbucking pairs & signs for their corresponding topological categories.

Math 29

$$Je = 4, 6, 8, 10, \ldots\ Je \text{ even}$$

$$\Rightarrow \binom{3}{1}, \binom{5}{2}, \binom{7}{3}, \binom{9}{4}, \ldots, \binom{Je-1}{\frac{Je}{2}-1} \text{ pairs \& signs}$$

$$\Rightarrow 3, 10, 35, 126, \ldots \text{ pairs \& signs.}$$

If this holds, then Math 30a&b show the analysis deriving $N_{T\text{-}HOCT}$ and $K_{COCT}$ from Math 28 and 29.

Math 30a $$(8):\ 8*\left[\binom{8}{8}*35(\text{with pairs \& signs})\right]*N_{SGN-HP} = 8*[1*35]*1 = 280$$

$$(6+2):\ 12*\binom{8}{2}*\left[\binom{6}{6}*10(\text{with pairs \& signs})\right]*N_{SGN-HP} = 12*28*[1*10]*2 = 6720$$

$$(4+4):\ 11*\left[\binom{8}{4}*3(\text{with pairs \& signs})\right]*\left[\binom{4}{4}*3(\text{with pairs \& signs})\right]*N_{SGN-HP} = 11*[70*3]*[1*3]*2 = 13860$$

$$(4+2+2):\ 36*\left[\binom{8}{4}*3(\text{with pairs \& signs})\right]*\binom{4}{2}*\binom{2}{2}*N_{SGN-HP} = 36*[28*3]*6*1*4 = 75576$$

$$(2+2+2+2):\ 11*\binom{8}{2}*\binom{6}{2}*\binom{4}{2}*\binom{2}{2}*N_{SGN-HP} = 11*28*15*6*1*8 = 221760$$

where $N_{SGN-HP} = 2^{\#entities-1}$.

-continued $$N_{T-HOCT} = 280 + 6720 + 13860 + 75576 + 221760 = 318196 \quad \text{Math 30b}$$

$$K_{COCT} = \binom{K}{8} * N_{T-HOCT} = \binom{K}{8} * 318196,\ K \geq 8$$

$$\text{for } K = 8, 9, 10; \binom{K}{8} = 1, 9, 45;$$

$$K_{COCT} = 318{,}196;\ 2{,}863{,}764;\ 14{,}318{,}820.$$

Note that to get anywhere near 250,000 potentially different humbucking tone outputs with switched topological combinations of matched single-coil pickups, one needs at least 8 pickups with connections including humbucking pairs, quads, hextets and octets. Even at that, the pickups will be so close together that their fields will likely be entangled and change the results, possibly producing fewer distinct tones. Only experiment can tell.

Compilation of Theoretical Results

Using Math 16, 20, 27 & 30, Math 31 shows the numbers of potentially distinct humbucking tones for K=2 to 8 matched single-coil pickups, reduced by those deemed duplicates by circuit theory. Since at most about 8 single-coil pickups will completely fill the available space between the neck and bridge of an ordinary guitar, K>8 is not considered. For example, if K=6, up to 30 humbucking pairs, 495 humbucking quads and 568 humbucking hexes can be switched to the output, for a total of 1093 humbucking outputs. Math 32 shows the percentage of potentially distinct humbucking tones for the figures in Math 11.

Math 31. Numbers of potentially distinct humbucking tones for 2 to 8 matched single-coil pickups

| K | Pairs | Quads | Hexes | Octets | Sums |
|---|---|---|---|---|---|
| 2 | 2 | | | | 2 |
| 3 | 6 | | | | 6 |
| 4 | 12 | 36 | | | 48 |
| 5 | 20 | 180 | | | 200 |
| 6 | 30 | 540 | 2560 | | 3130 |
| 7 | 42 | 1260 | 17920 | | 19,222 |
| 8 | 56 | 2520 | 71680 | 318,196 | 394,452 |

Math 32. Percentages of potentially distinct humbucking tones for 2 to 8 matched single-coil pickups compared to total possible connections in Math 12b

| K | Pairs | Quads | Hexes | Octets | Sums |
|---|---|---|---|---|---|
| 2 | 50% | | | | 33.3% |
| 3 | 50% | | | | 12.8% |
| 4 | 50% | 7.8% | | | 7.7% |
| 5 | 50% | 7.8% | | | 1.8% |
| 6 | 50% | 7.8% | 1.1% | | 1.1% |
| 7 | 50% | 7.8% | 1.1% | | 0.28% |
| 8 | 50% | 7.8% | 1.1% | * | * |

(* - not available)

Clearly the larger the number of pickups and number of possibly different topologies and sub-combinations, the smaller the percentage of output that are humbucking with potentially distinct tones.

A Set of Special Cases

FIG. 13*a* shows two single-coil pickups with north poles up connected in parallel, the pair connected in series to a single-coil pickup with the south pole up, with a load resistance, $R_L$. The plus signs on the coils indicate the phase of the signal from string vibrations. FIG. 13*b* shows the equivalent circuit, with the coils replaced by an equivalent equal impedence, Z, and equivalent hum voltages, Va, Vb & Vc in series with each Z, with a load resistance, $R_L$. Note that the hum voltage in the upper, south-up coil is the opposite phase to the hum voltages in the lower, north-up coils. Because of the loading of each north-up coil on the other, the hum voltage across the parallel north-up pickups is equal and opposite to the hum voltage on the single south-up coil. The phases of string vibration signals are not shown in FIG. 13*b*.

According to circuit theory, treating Z as a resistance at a single frequency, should work so long as all the pickups generate the same frequency and level of hum voltage, i.e., $Va=Vb=Vc=V_H$, for a uniform external electromagnetic hum field, and the coil resistances and impedances are equal for all frequencies of external hum. Then one or more pickups with north-up poles can be connected in parallel with each other, and in series with a group of one or more parallel south-up poles, to produce a humbucking circuit. This will work for any number of matched pickups, odd or even. A group of pickups with north-up poles can be connected in parallel, and in-phase with respect to string vibration signals. A second group of pickups with south-up poles can be connected together in parallel and in-phase with respect to string vibration signals. So long as all the pickups are constructed to have the same internal impedance and resistance, and to generate the same amplitude of signal from a uniform external hum field, the two groups can be connected in series and in phase with respect to string vibration signals and the whole circuit will still be humbucking.

In this way humbucking circuits can be constructed for odd numbers of matched single coil pickups, so long as there is at least one north pole up and at least one south pole up. This would add 3-coil circuits, as in FIG. 1*c-c*(2+1), and a 5-coil circuit, as in FIG. 3*b-u*(3+2), to guitar with two humbuckers and a single-coil pickup. This also raises the possibility of FIG. 2*a-g*(3+1) being a quad humbucking circuit, and FIG. 3*b-v*(3+2) being a quint humbucking circuit. But these circuits will be humbucking only if all the coils in both humbuckers and single-coil pickups have the same impedance and pick up hum signals equally.

Suppose that there is a dual-coil neck humbucker, a dual-coil bridge humbucker and a single-coil pickup in the middle, and that all the coils are matched in resistance, inductance, and response to external hum. Suppose that the coils are labeled NN for the neck coil with a north up (N-up) magnetic field, SN for the neck coil with south up (N-up), NM for the middle coil with N-up, NB for the bridge coil with N-up, and SB for the bridge coil with S-up. Here we us "||" to indicate parallel connection, and "+" to indicate series connection. According to the special case approach, we can have the 9 humbucking triples: (SN||SB)+NM, NN & NB, (NN||NM)+SN & SB, (NN||NB)+SN & SB, and (NM||NB)+SN & SB. We can have the 3 humbucking quads: (SN||SB) ±(NN||NM), (NN||NB) & (NM||NB). We can have the 1 humbucking quintuple: (SN||SB)+(NN||NM||NB). Those are all in-phase combinations.

By extension of the method, we can also 3 contra-phase humbucking triple combinations: NN−(NM||NB), NM−(NN||NB) and NB−(NN||NM). If the special case holds, This would add 15 humbucking circuits to the 20 for 2 humbuckers in Math 14, for a total of 35 potentially unique tones, as compared to 200 potentially unique tones for 5 separated and matched coils, shown in Math 31. It remains to be seen how many of those tones are distinct from each other.

DESCRIPTION OF INVENTION

Although one may not patent mathematical equations, one can patent the combinations of physical objects described and predicted by math and topology in the sections above. The following uses the math and topology developed above to more concretely discuss such combinations. Note that in the matter of electric guitars with dual humbuckers with a 3-way switch, and three single coils with a 5-way switch, some of the simpler pickup circuit combinations presented here have been long in use and are not novel. But the development of methods to clearly identify which simple and complex combinations of vibrations sensors are tonally distinct and which are humbucking is novel, and renders patentable all other circuits predicted and described those methods.

Mechanical Switching of Dual-Coil Humbuckers

Recall that dual-coil humbucking pickups commonly comprise of one magnet between two coils with poles in their centers. In some versions, one pole is up and one down. When the poles of both coils are pointed up, one must be magnetic north and the other must be south. In Jacob's FIG. 11 (US2009-0308233-A1), he combines equal and opposite poles, one each of two dual-coil humbuckers, in Throw 2, 3, 4 and 5. This also occurs in his FIG. 12 in throws 2, 3 and 4. This requires taking 2 wires for each coil, 4 for each humbucker, into the switching network, where the series and parallel connections are made. Does it make more sense to make the series and parallel connections between the two coils of a single humbucker, and bring only 2 wires into a switching network?

Recall that the $32^{nd}$ harmonic of the fundamental of the 0 fret and the $16^{th}$ harmonic of the fundamental of the $12^{th}$ fret on an average guitar span a distance of about 0.8", about the same as the distance between the centers of humbucker pickup poles and coils. This means that for most if not all the vibration frequencies of interest, both poles of a single humbucker see essentially the same string vibration signal. If this holds true, then circuit theory says that the output signal of two humbuckers in-phase and in parallel is effectively equal to the string vibration signal from the north pole of one humbucker and the south pole of the other, connected in-phase and in parallel.

Figure 11:
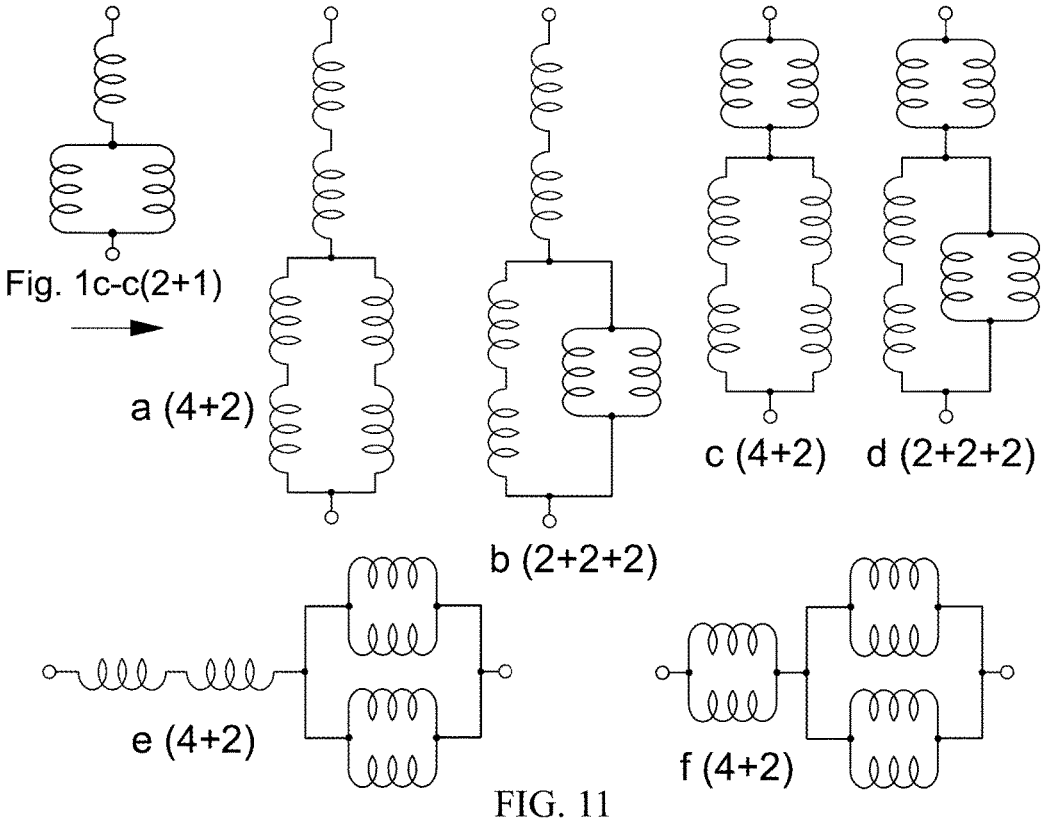
FIG. 11, shows how series and parallel pairs of pickups replace the single pickups in FIG. 1*c-c*(2+1) to produce humbucking hexes, with 4 versions of subcategory (4+2), and 2 versions of subcategory (2+2+2).
Figure 12:
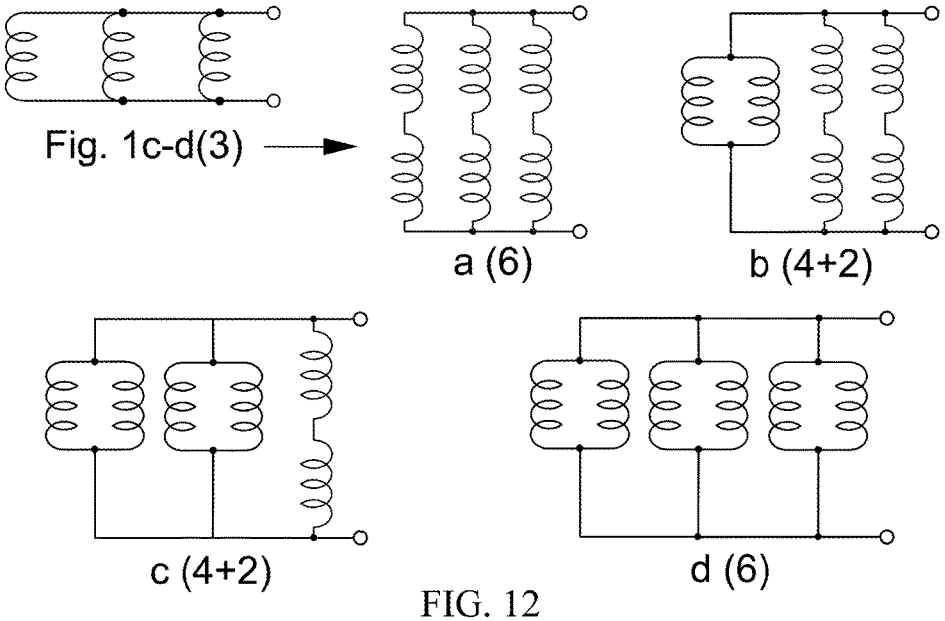
FIG. 12, continuing the development of FIG. 11, shows how the three parallel single coil pickups of FIG. 1*c-d*(3) are all replaced by pairs of series single-coil pickups, which are then replaced in turn by all possible combinations of pairs of parallel single-coil pickups, to produce 2 versions of subcategory (4+2) circuit topologies and 2 versions of subcategory (6) circuit topologies.

Likewise, the output signal of two humbuckers connected in parallel and out of phase, or contra-phase, is effectively equal to the signal of the north pole of one humbucker connected in parallel and contra-phase with the north pole of the other. The same holds true for the south poles from each humbucker connected in parallel and contra-phase, which is also equal in signal to the north pole contra-phase connection. Likewise, one can reasonably expect the same to hold true of coils and humbuckers connected in series. So a fair number of the connections shown in Jacob's FIGS. 11 & 12 are tonal duplicates.

Thus, as far as mechanical switches are concerned, it is easier to organize and combine the signals from two humbuckers if the coils in each one are connected in series and parallel before subsequent switching, leaving just two wires for each humbucker connected to subsequent switches. This makes the use of existing mechanical switches for subsequent switching more feasible, such as a common and inexpensive, 2-wafer, 4P6T rotary switch.

Figure 14:
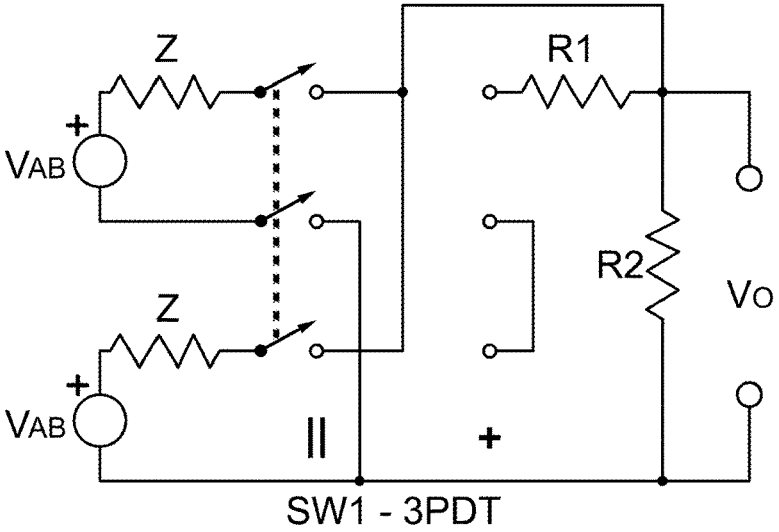
FIG. 14 shows the output of two matched single-coil pickups, or the two coils of one humbucking pickup with a 3PDT switch, switched to produce parallel and series connections, and to reduce the inherently higher series output to the same level as the parallel output, by means of a passive component network voltage divider.

FIG. 14 shows a circuit diagram for a dual-coil humbucker, a 3PDT switch, SW1, and two resistors, R1 and R2. Each coil of the humbucker comprises of a voltage signal source, $V_{AB}$, due to string vibration, and an impedance, Z, comprised of the coil resistance, inductance and a small amount of capacitance, which capacitance will be ignored for this discussion. When SW1 is thrown to the left-hand terminals, indicated by the coils are connected in parallel with each other and a resistor, R2, and the output, indicated by the voltage, Vo. When SW1 is thrown to the right-hand terminals, indicated by +, the coils are connected in series, with a resistor divider, comprised of R1 and R2 between the series-connected coils and the output, Vo.

Without R1 and R2, when the coils are in parallel and series, and if there is no load on the output voltage, Vop and Vos, respectively, then Math 33 shows the output voltage and the source impedances, Zop and Zos, seen at the output.

$$\text{Parallel w/o } R1\&R2: V_{OP}=V_{AB}; Z_{OP}=Z/2$$

$$\text{Series w/o } R1\&R2: V_{OS}=2*V_{AB}; Z_{OS}=2*Z \qquad \text{Math 33.}$$

where $Z \approx \sqrt{R_{AB}2+(2*\pi*f*L_{AB})^2}$, $R_{AB}$=coil resistance (a), $L_{AB}$=coil inductance (H), f=frequency of vibration signal (Hz)

Obviously, serial connections of internal humbucker coils, and even single coils in general, tend to have higher output signals, which are evident in switching between them. The split coils of Krozack, et al., (US 2005/0150364A1, 2005) meant to address this problem. But it can also be addressed with resistive voltage divider circuits, even if the overall result requires manual adjustment of the resistors, or a potentiometer, until the volumes seem equal.

Impedance Z is actually a complex number, but for the purpose of this discussion, it will be treated as a resistance at a given frequency of string vibration. One might choose the mean frequency of six strings strummed on fret 0, but this would be an iterative experiment, because the interaction between the coil impedance and resistors would affect the result. The fundamental of the first string at the $12^{th}$ fret in standard EADGBE tuning is 659.2 Hz. For example, if the coil resistance is 10 kΩ and the inductance is 2 H, then 2πfL has a magnitude of 4142/H or 8284 complex ohms, and the impedance, Z, is about 13 kΩ For lower frequencies, Z is closer to 10 kΩ, because the value of 2πfL drops with frequency, f.

$$V_{OP} = \frac{2*R_2}{2*R_2+Z}, Z_{OP} = \frac{R_2*Z}{2*R_2+Z} \qquad \text{Math 34}$$

$$V_{OS} = \frac{2*R_2}{R_1+R_2+2*Z}, Z_{OS} = \frac{R_2*(R_1+Z)}{R_1+R_2+2*Z}$$

$$V_{OP} = V_{OS} \Rightarrow R_1 = R_2 - Z.$$

Treating Z as a resistance, Math 34 shows Vop, Zop, Vos and Zos for parallel and series circuits in FIG. 14, with R1 and R2 in the circuit. Using R1 and R2 makes it possible to change the outputs for Vos from $2*V_{AB}$ to nearly equal to $V_{AB}$, removing the necessity to change the guitar output volume in going from Vop to Vos and back. Suppose that R2 is nearly 10 times Z or 120 k, and R1 is nearly R2−Z, or 100 k. Then at 659.2 Hz, Vop is approximately 0.95 times $V_{AB}$, and Vos is approximately 0.98 times $V_{AB}$, a difference of only $0.03*V_{AB}$. Zop and Zos are about 6.2 k and 61 k, respectively. In this example, the price at 659.2 Hz for equalizing Vos and Vop is a slight decrease in perceived V and Zop, and about a 2.4 times increase in Zos.

Since the signals in resistors have a different phase from those in inductors, the subsequent combinations of humbuckers by mechanical switching, where resistor-inductor circuits are connected to other resistor-inductor circuits, may well produce signals which are not purely in-phase, out-of-phase or contra-phase. Only experiment can verify results. Note that adding resistors across the outputs of series and parallel coil connections will have the result of lowering the roll-off frequency due to coil inductance, making the combinations sound darker or warmer than they would otherwise. This could promote the use of contra-phase signals, which tend to partially cancel out frequencies at and close to the fundamental string vibration, to achieve brighter tones.

Figure 15:
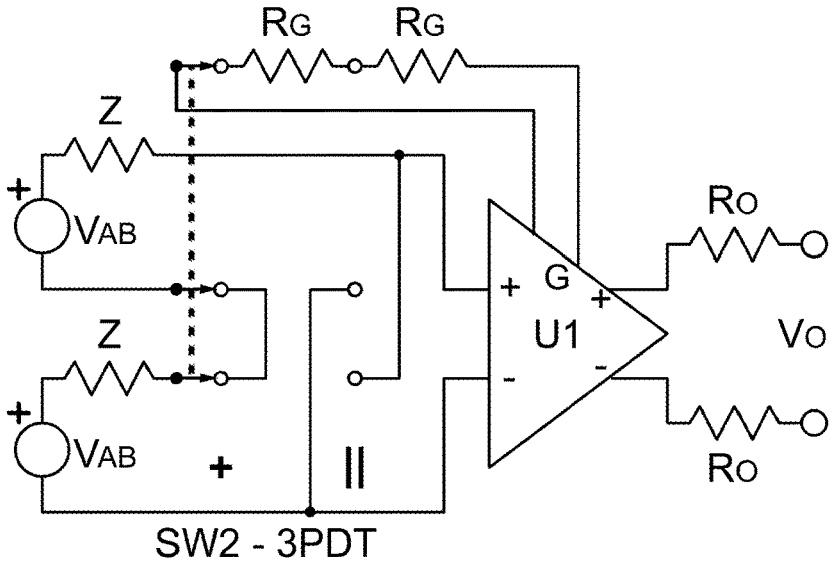
FIG. 15 shows a similar circuit to FIG. 15, but buffered on the output with a variable-gain differential amplifier, in the instance where the gain is inversely proportional to $R_G$, to assure the same kind of signal averaging presented in FIG. 14, with output resistors, Ro.

If electric or battery power is available in the stringed instrument for active electronics, then pickups can be isolated from each other with respect to phase interactions by using isolation differential amplifiers. FIG. 15 shows an alternative method of equalizing series and parallel humbucker or circuit voltages, using 3PDT switch, SW2, a differential amplifier, U1, with a switched gain control resistor, $2*R_G$ for series and $R_G$ for parallel. The differential amplifier would isolate one humbucker from another, allowing only the addition and subtraction of voltages in subsequent switching. There would be no electrical interaction between the impedances of separate humbuckers or pairs. So series and parallel connections of separate Vo signals from separate differential amplifiers would have no difference in tone. Additional output resistors, Ro, might need to be added between U1 and the output voltage, Vo, to assure proper averaging of signals connected in parallel. Differential amplifier U1 also provides the advantage of rejecting any common-mode noise impressed upon the humbucker by external fields.

In this circuit, the gain is presumed to be inversely proportional to the gain resistor, so that the series gain is halved compared to parallel. If the converse were true, the $3^{rd}$ pole of the switch would be used to short the resistor $R_G$ on the left, to make it $R_G$ for series and $2*R_G$ for parallel. Note that the 3PDT switch, SW1 in FIG. 14 or SW2 in FIG. 15, could be either mechanical or electronic, such as a 4PDT solid-state crossbar switch, normally used in SIM, USB or headphone switching. It is even possible to include a series-capacitor-potentiometer tone control across the output of FIGS. 14 & 15. In FIG. 15, a tone control would probably work better with output resistors, Ro, in place.

Figure 16:
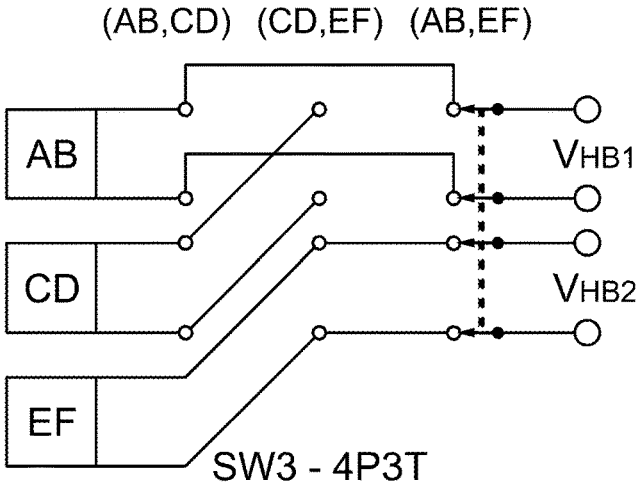
FIG. 16 shows how a common 4P3T rotary switch can be used to cycle combinatorial pairs of 3 sensors, AB, CD and EF, 3 things taken 2 at a time, especially humbuckers connected to circuits like FIG. 14 or 15, to a pair of outputs.

FIG. 16 shows a common single-wafer 4P3T rotary switch, SW3, to select three humbuckers, AB, CD and DF, into 3 pairs, (AB,CD), (CD,EF) and (AB,EF). If humbucker AB is a the bridge of a guitar, EF the neck, and CD in the middle, this sequence could be expected to tend from bright to warm. The inputs AB, CD and EF could be either humbuckers wired either series or parallel internally and directly connected, the output of 2 circuits of FIG. 14, or the output of 2 circuits of FIG. 15, or some combination thereof.

Figure 17:
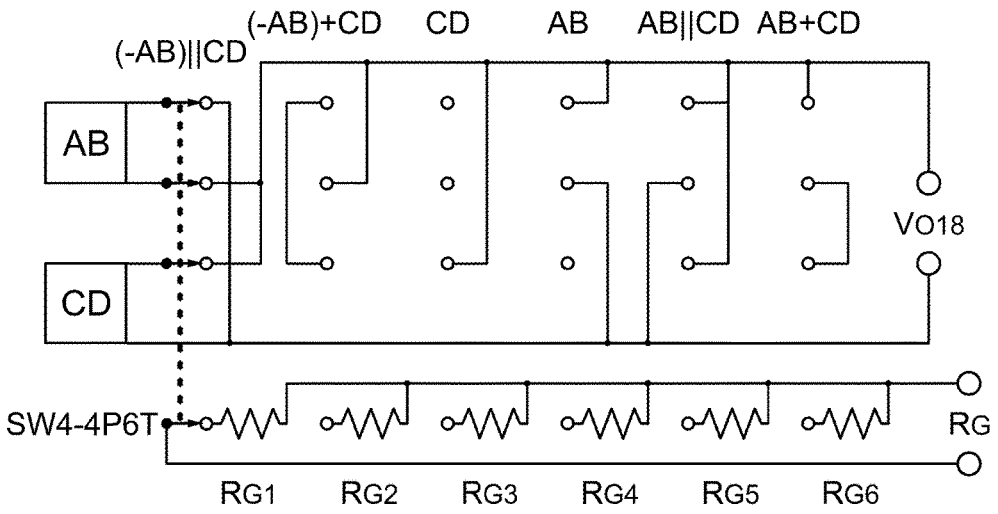
FIG. 17 shows how two humbuckers, either buffered or not by circuits like FIG. 14 or 15, either as two individual humbuckers or the output of a selection circuit like FIG. 17, can be connected by a common 4P6T rotary switch to produce 4 humbucking pair outputs and 2 single humbucker outputs which have potentially distinct tones.

FIG. 17 shows a common double-water 4P6T rotary switch, SW4, with the humbuckers AB and CD connected to three poles, where the 6 throws are wired to provide at the output the combinations (−AB)‖CD, (−AB)+CD, CD, AB, AB‖CD and AB+CD. The symbol "‖" indicates the humbuckers wired to each other in parallel, the symbol "+" indicates a series connection, and the symbol "−AB" indicates that the connections of AB have been reversed to be out-of-phase with CD. AB and CD could be two humbuckers wired directly to the input of FIG. 17, or the outputs of two circuits like FIG. 14, or the outputs of two circuits like FIG. 15, or the output of FIG. 16. The fourth pole of SW4 is used to switch gain resistors for a subsequent differential amplifier, if any, so as to equalize the volume of the six different outputs.

If 2 humbuckers are wired directly to the input of FIG. 17, AB at the bridge of a guitar and CD at the neck, then it provides 6 choices, in a possible expected order from bright on the left to warm on the right. Compare this to the standard 3-way switch which offers AB, AB‖CD and CD. If 2 of FIG. 14 or 2 of FIG. 15 are wired to the input of FIG. 17, then either 2) SW1 or 2) SW2 provides $2^2=4$ different parallel-series switch choices, times the six of SW4, or 24. Of these 24, 4 are duplicates, because while AB only is connected to the output of FIG. 17, SW1 or SW2 on CD has no effect, and vice versa.

In the section "A dual-humbucker experiment", shown in FIG. 5 which used switching circuits like those in FIGS. 14 & 17, without R1 and R2 in FIG. 14 and Math 15, produced Math 24. It is possible that ignoring complex math and using Z as a resistance, and in connecting pickups directly to each other, has produced unexpected results. In the experiment, all six strings of a electric guitar were strummed midway between the pickups, one time each for frets from 0 to 5, for a total of six times. A computer sampled the output of the guitar at 44100 Hz, using 4096 samples per Hann window to calculate the FFT, resulting in 2048 amplitudes from 0 Hz to 22039 Hz. This produces a frequency resolution of 10.77 Hz, which on the E 6th-string fundamental spans about 3 frets.

This may be a problem, because the results, when converted to probability density functions, produced mean frequencies far above the string fundamentals. Subsequent limited experiments demonstrated that better resolution, i.e., lower sampling rates with higher resolution, produced lower mean frequencies and visibly sharper peaks in the amplitude versus frequency plots. But at the cost of not measuring higher frequencies. Had the right equipment been available, it would have been preferable to measure with at least 1 Hz resolution from 0 to 10000 Hz, meaning 20000 samples per second with an FFT sampling window on the order of $2^{15}=32768$ samples.

Let ABs mean humbucker AB at the neck, with its internal coils connected in series, and $AB_P$ with its coils connected in parallel, as in FIGS. 14 & 15. Humbucker CD is a the bridge. Circuit theory suggests that $AB_S|CD_S=AB_P+CD_P$ and $(-AB_S)\|CD_S=(-AB_P)+CD_P$. But not necessarily. The experimental circuit that produced FIG. 5 had two humbuckers of the same model connected to a 4P6T switch like that in FIG. 17, through two circuits like FIG. 14, but without R1 and R2. Note in Math 24 that Np+Bp and Ns‖Bs are almost close, at 1009 Hz and 1057 Hz, though there are two more mean frequency points at 1026 Hz and 1041 Hz in between them, but (−ABp)+CDp, at 1571.5 Hz, and (−ABs)‖CDs, at 1408.3 Hz, are not. The first two mean·frequencies in FIG. 5, 801 Hz and 808 Hz, corresponding to switch positions for $(-AB_S)\|CD_P$ and $(-AB_S)\|CD_S$, also indicate possible duplicate tones. And the next two at 907.4 Hz for ABs and 906.9 Hz for ABp+CDs are as good as identical. These, leaving 17 of the 20 as distinct, and 7 of the 24 as duplicates.

FIG. 5 also compares the 20 measured outputs with an equivalent 3-way switch, using the same pickups. The circle data points on the graph represent the equivalent 3-way switch outputs with the internal humbucker coils connected in parallel, and the triangles, in series. Even with possible experimental errors, the 20-way switching system demonstrates a much wider range and distinction of tone than the standard 3-way switch.

If 3 humbuckers, each with a series-parallel switch, like FIG. 14 or 15 are connected to a 2-of-3 selection circuit like FIG. 16, which is collected to a combination switching circuit like FIG. 17, then, assuming the experimental results in FIG. 5 hold, 3*17=51 distinct tones are possible out of a possible maximum of 60. This can be done with 5 ordinary mechanical switches: 3)3PDT, 1)4P3T and 1)4P6T. Considering the limited space under an electric guitar pick guard, this may be the practical limit for mechanical switching of humbuckers. Compare 51 possible tones with 3 humbuckers to the 3 humbuckers and a 5-way switch for the Music Man St. Vincent guitar. So by using 5 switches instead of 1 on the St. Vincent guitar, one could have about 10 times as many tones.

Limits of Mechanical Switches for Humbucking Pairs and Quads

Figure 13:
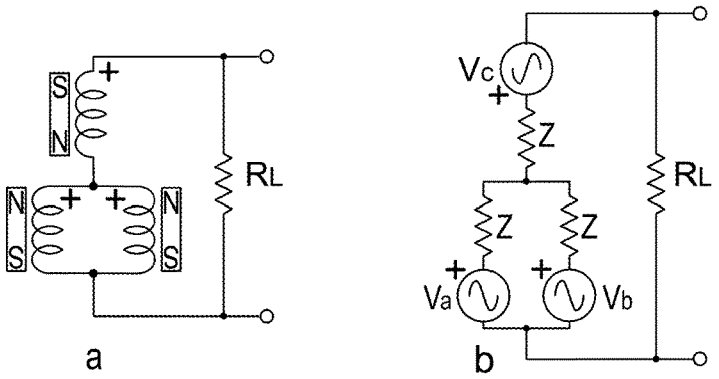
FIG. 13*ab*, using the example of 3 single-coil pickups, 2 in parallel with north poles up connected in series and in-phase to 1 with a south pole up in FIG. 13*a*, shows in FIG. 13*b* the simplified hum voltage circuit which indicates that the 3-pickup circuit can be humbucking, due to the way the matched north-up pickups load each other.
Figure 18:
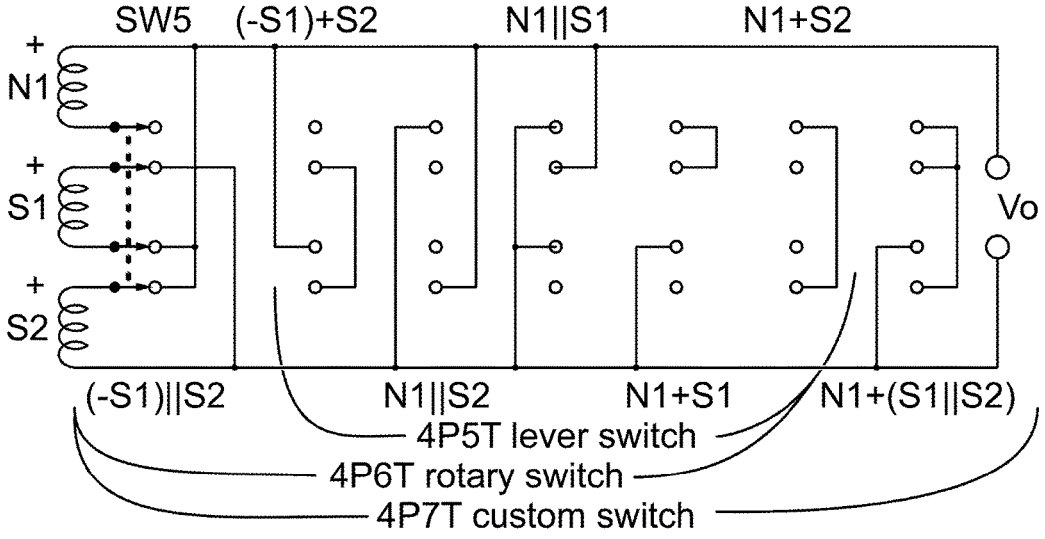
FIG. 18, using the example of 3 matched single-coil pickups with one north pole up and two south poles up, shows how they can be combined, by 4P5T lever-style "superswitch", or a 4P6T rotary switch, or a hypothetical 4P7T switch, into 5, 6, or 7 outputs that are humbucking and potentially tonally distinct.

FIG. 18 shows a 4P7T switch, SW5, connected to three matched single-coil pickups, with one north pole up and two south poles up, producing the 6 humbucking pairs predicted by Math 16, as covered by U.S. Pat. No. 9,401,134 B2 (Baker, 2016), and a special case of 3 pickups connected in a humbucking triple, as shown in FIG. 13. The order from left to right roughly approximates bright to warm tones. A previous prototype switching system on a Fender Strat™ used a 5-way lever-style 4P5T "superswitch" to make connections similar to the middle 5, from (−S1)+S2 to N1+S2. The "superswitch" is a 2-wafer rotary switch mounted sideways, with 2 poles per wafer. Another prototype switching system, using a 2-wafer 4P6T rotary switch on the same guitar, made 6 similar connections to the all but the special case triple on the right. The brackets in FIG. 18 shows these possible connections for 4P5T and 4P6T switches, plus an imagined custom 4P7T switch.

Figure 19:
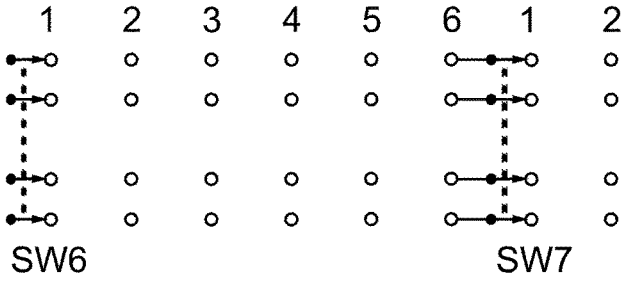
FIG. 19, using the example of a 4P6T switch and a DPDT switch shows how they can be concatenated to produce a hypothetical 4P7T switch.

There is no commonly made and widely available 4P7T switch. Most rotary switches have 12 positions on one wafer, and can have some combination of M poles and J throws, where M*J=12. A custom 4P7T switch which could actually fit in a guitar could be prohibitively expensive, since it would likely require new tooling for manufacture. Any solution for 3 pickups using common switches would have to involve concatenating switches, as shown in FIG. 19. Only the switch poles and throws are shown, no pickups or connections. Here, the $6^{th}$ and last throw position of a 4P6T rotary switch, SW6, is connected to the poles of a DPDT toggle switch, SW7. So the first 5 throws on the rotary switch and the 2 throws on the DPDT switch are available for pickup connections. Any number and kind of switches can be concatenated in this manner, until the available space on the stringed instrument is full. If there are J number of switches, with P number of poles each and Mi number of throws per switch, where i=1 to J, and the switch with $M_J$ throws is the last in the concatenation, then Math 35 shows the total number of throws, $M_T$, available.

$$M_T = M_J + \sum_{i=1}^{J-1}(M_i - 1) = 1 - J + \sum_{i=1}^{J}(M_i). \qquad \text{Math 35}$$

FIG. 19 can also be turned end for end and extended with more switches, to replace FIG. 16 and attach $M_T$ pairs of humbuckers to the input of FIG. 17. In like manner, it can also be used to attach $M_T$ humbucking pairs to FIG. 14 or 15. For K=4 matched single-coil pickups, there are 12 humbucking pairs. This would require 3 switches for a reversed FIG. 19 and Math 35, either three 5-way superswitches, 4+4+5=13 choices, with the last position blocked, unused or a duplicate, or two 4P6T rotary switches and a DPDT switch, 5+5+2=12 choices. For K=5 and 20 humbucking pairs, this selection setup would require 5+5+5+5=20, or three 4P6T switches and a 5-way superswitch. This would be unwieldy and impractical.

Past about 3 or 4 pickups or other sensors, there is little if any room left on a conventional electric guitar for ordinary switches. Just for humbucking pairs, concatenated, commonly-available switches don't have enough poles. The pattern of signs duplicates beyond $N_{SGN}=2^{J-1}$ in Math 7, 8ab & 9ab implies that one can always attach one terminal of one pickup to either the low or high side of the output, as is done with humbucker CD in FIG. 17. But given matched single-coil pickups, N1 (for north-up), S1 (for south-up), N2 and S2, just a few examples show that one cannot do this with two pickups, as shown in the series-parallel DPDT circuit in FIG. 15. Setting up the following examples, −(N1+S1)‖(N2+S2), −(N1+S1)±(N2+S2), −(N1‖S1)‖(N2‖S2), (N1‖S2)+(N2‖S1) and N1+S1+N2+S2, in a similar switching network (not drawn), shows that one and only one pickup can be connected to the high or low side of the output, requiring a switch of 7 poles. Further, there are up to 4 interconnects required between pickup terminals in any cross-point board, one more that the 3 shown as item (387) in FIG. 30 of U.S. Pat. No. 9,401,134 (Baker, 2016). So in the more complicated matter of humbucking quads, hexes and octets, using ordinary mechanical switches in FIG. 19 fall far short.

Solid-State Switching for Humbucking Pairs, Quads, and Up

A digitally-controlled analog crosspoint switch with Mx x-inputs and My y-inputs, has Mx times My crosspoint interconnections with $2^{Mx*My}$ switch choices. All of the pickup terminals are connected to both the x and y inputs, with at least two extra for the outputs. So for Mx pickup terminals, My must be greater than or equal to Mx+2 to account for the two output terminals. For example, if there are 4 humbuckers with integral series-parallel switches, or 4 humbucking pairs, then Mx must be at least 8, and My must be at least 10. And the inherent $2^{80}$ or more interconnections choices is a very large number, well beyond the needs of the pickup switching discussed here.

Commonly-available crosspoint switches, such as the Zarlink MT093 iso-CMOS 8×12 analog switch array, ~$7/each, and the Intersil CD22M3494 BiMOS 16×8 crosspoint switch, ~$6.50/each, require digital sequencing and control for the crosspoint switch array. This means a micro-controller, particularly a low-power micro-controller. It is possible to concatenate crosspoint switches to form, for example, a 16×16 from two 8×16 crosspoint switches. Subtracting 2 for the output, that leaves 14 pickup terminals to connect, either 7 matched single-coil pickups, or 7 humbuckers with integral series-parallel switching. For 8 single-coil pickups, or 4 humbuckers with all four terminals, plus an output connected to the crosspoint switch, a 16×18 or larger switch is needed, such as four 8×12 switches concatenated into a 16×24 switch.

Here one parts company with the Jacob application (US 2009/0308233 A1) and Ball patents (U.S. Pat. No. 9,196,235, 2015; U.S. Pat. No. 9,640,162, 2017). It is neither necessary nor desirable either to have separate pickup and circuit selection, as Jacob required, or to have input and output controls look exactly the same as current guitars and basses and other stringed instruments, as Ball required. A crosspoint switch combines both selection and connection circuits. And using only classic controls with knobs can be too limiting, requiring more control surface space than actually needed. Routing controls through the analog switching matrix means either that the number of possible vibration sensors, or pickups, will be limited by and compete with the number of control lines, or that the size of the analog switching matrix must be quite large to handle any number of pickups above 3 or 4, plus 3 to 5 controls. It is more efficient to use digital controls and multiplexers, connected directly to the micro-controller, which can also provide any drive signals necessary. Modern digital mice and smartphones are a perfect example.

Figure 20:
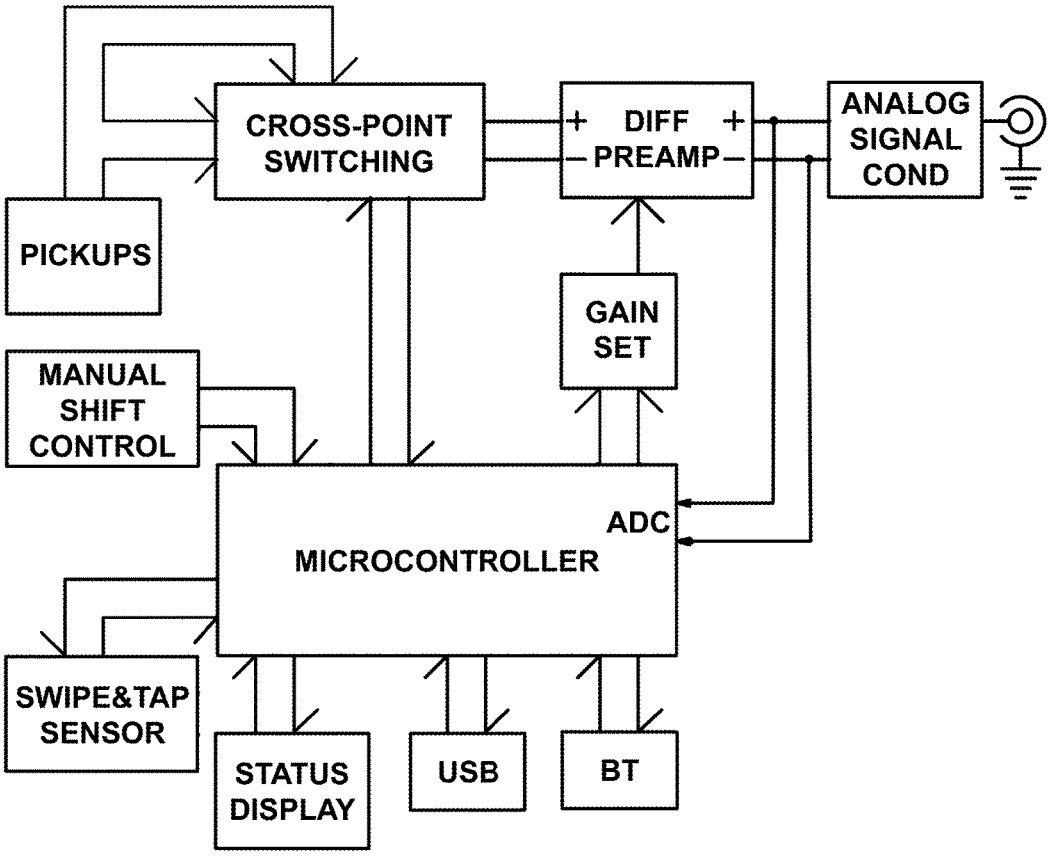
FIG. 20 shows pickups connected to a cross-point switching array, digitally controlled by a micro-controller, which with simple manual inputs will allow a musician to choose output tones without reference to which pickups are connected together how, and with output gain control to reduce the need to manually change any downstream volume control with cross-point switch settings, and with analog-to-digital feedback to allow the micro-controller program to test the switch settings to determine, by means of spectral analyses, which are perceptibly brighter or warmer in tone, so as to set a particular sequence of tones for the manual control to shift through or choose as presets. The "manual shift control" refers to simple electromechanical switches, or a mouse wheel and buttons, debounced either at the switch or in microcontroller programming, for the purpose of controlling programming modes, changing tonal sequences, or shifting along a tonal sequence of pickup combinations. The "swipe&tap sensor" denotes possible non-mechanical optical, capacitive, resistive or other sensing technology to achieve similar ends. The "status display" may comprise of anything from simple binary "blinken" lights to flat-panel displays with touch sensors incorporated, as on a smart phone.

FIG. 20 shows a different concept. Instead of nearly every control going through the switching matrix, as in the Ball patents, all go through the microcontroller. Only the pickups, or any other sensors, and the microcontroller provide inputs to the crosspoint switch. As indicated previously, the box "PICKUPS" refers to any number and kind of sensors. The only output from the crosspoint switch is connected to a differential amplifier with a gain set by the microcontroller. The "analog signal conditioning" block can be as simple as a volume pot, or add more complex audio aftereffects circuits. The "manual shift control" is the most basic control. It can be embodied as merely a binary up-down, debounced, momentary contact toggle switch, or push buttons, that triggers a count up and down through a preset sequence of pickup combinations, with a total up to those numbered in Math 12ab, 13ab & 14, or 31. The most basic output for a "status display" is a set of binary lights, controlled by the micro-controller, which merely turn on or off to indicate the position of the selection in the sequence. It could also be an alpha-numeric segment display, or pixel array display, especially if the selection sequence is more than 6 or 8 long.

But much more is possible. The "manual shift control" could be like the scrolling wheel on a mouse, with rotation to change selection and the down, left and right switches to change modes, such as setting presets of favorite tones, and moving tones up and down in the selection sequence. That kind of input could also be done with a "swipe & tap sensor", with a "status display" that shows alphanumeric data to indicate presets and selections, or done with a touch-sensitive screen like a smart phone, built into the stringed instrument. This could also be done with USB or Bluetooth, BT, or other digital connections, which could also be used to diagnose and reprogram the microcontroller, if needed.

Most if not all current microcontrollers have an analog-to-digital converter, or ADC. In U.S. Pat. No. 9,401,134 (Baker, 2016) pickup position can be changed to any position, attitude and height between the neck and bridge. This would change any bright-to-warm preset sequence of humbucking or other combinations. So would changing the model of any of the pickups. So the ADC converter is used to perform frequency spectrum analysis on the results, to aid in re-ordering the selection sequence from bright to warm. And if it becomes hopelessly confused, the mode switch setting on the "manual shift control" or the "swipe&tap sensor" can be used reset the sequence to a factory setting.

Using a fast-Fourier transform, or FFT, computed by the micro-controller, spectral analysis could be done by manual strumming of the stringed instrument, as noted in the "dual-humbucker experiment" above, or by means of an automatic strumming device, attached to the stringed instrument and controlled by the micro-controller via USB or another digital connection. Math 15 and the associated text show the methods and numbers likely to be of most use in determining the initial sequence of bright to warm. Which could be modified by the musician with presets or re-ordering of the sequence, should perception prove different. This will also identify which tonal outputs may be duplicates, and thus may be excluded from the sequence.

The invention claimed is:

1. A method for interconnecting the signal outputs of K number of electrical sensors, also known as pickups, especially vibration sensors for the vibrating parts of musical instruments, in circuit topologies of J number of said sensors at a time, such that duplicate topologies with electrically equivalent circuits and vibrational outputs, also known as tonal outputs, also known as output timbres, are eliminated from consideration, comprising the steps of:

a. designating categories of electrical circuit topology, as category (1), (2), . . . (J), such that category (M) is comprised of M of said pickups connected together, where $1 \leq M \leq J$, such that, a.i. beginning with 1 of said pickups, designated as said category (1) with 1 member, constructing said category (2) with 2 members, a.i.1. connecting 1 of said pickups in series with another 1 of said pickups, for one member of said category (2), and a.i.2. 1 of said pickups in parallel with another 1 of said pickups for the other member of said category (2), and a.ii. constructing said categories of (M) for M>2 by the same process of connecting lower-orders of said categories in series and parallel, such that, for (M)=(3), all the members of said category (1) in series and in parallel separately with all the members of said category (2), and such that, for (M)=(4), all the members of said category (1) in series and parallel separately with all the members of said category (3), plus all the members of said category (2) in series and parallel with all the members of said category (2), such that said category (M) is constructed by connecting said category (1) in series and parallel to all the members of category (M-1), and by connecting the members of said category (2) in series and parallel with all the members of category (M-2), and continuing until all the members of category (N) are connected in series and parallel with all the members of category (M−N), wherein N is an integer less than or equal to M/2, such that, (M)=(5) be constructed from (1)&(4) and (2)&(3), and such that (M)=(6) be constructed from (1)&(5), (2)&(4) and (3)&(3), and up, excluding duplicates of any previously constructed topologies for said (M)>(3), such that this method shall be extendable to higher complexities, and a.iii. wherein each said topology of said category (M) may be deconstructed into t number of topologies of sub-categories, (Mi)=($M_1$), ($M_2$), . . . , (Mt), such that $M=M_1+M_{2+} \ldots +Mt$, with $1 \leq Mi \leq M$, such that the members of each said sub-category (Mi), i=1, . . . , t, comprise of Mi number of sensors connected all in series, or all in parallel, between two nodes with no circuit branches in between, also called a basic topology, such that the order of placement in the circuit of said basic sub-category (Mi) of said individual members of said sensors, without reversing phase or connections relative to the other said sensors, makes no difference to the timbre or tonal quality of the output of either said sub-category or said category (M), such that a set of allowable topologies of said category (4) can be constructed of members with sub-categories (2+1+1), (3+1), (2+2) and (4), and such that the set of allowable member topologies of category (5) may be constructed of members, or versions, with sub-categories (2+1+1+1), (3+1+1), (2+2+1), (4+1), (3+2), and (5), such that the number of allowable unique circuits of that subcategory is limited to the product of versions, or members, times the combinations of sensors allowed by the basic topologies in each sub-category, so that such distinctions can be used to determine how many possibly unique tonal outputs can be obtained from each of said J=M sensors, constructing combinations of sensors rearranged in all circuit positions, subject to the limits of combinatorial math, such that this method shall be extendable to higher complexities, a.iv. wherein the limit of the number of unique circuits from which K sensors can be constructed J at a time is less than or equal to the product of [K sensors taken J at a time] times the number of allowable sensor terminal reversals, $N_{SGN}$, times the sum of [the products of the number of said versions of each sub-category of circuit topology times the allowable number of combinations of J sensors in each sub-category, as determined by said basic topologies], b. constructing combinations of phase by switching in reverse said terminals of selected said sensors in each distinct topology, so that their phase relative to the remaining said sensors is inverted, producing a change in tone at the output, such that for a topology of said J number of said sensors there can be no more than $2^{J-1}$ different said combinations of said phase reversals of said sensors that produce potentially unique tonal outputs, constructed by taking one set of connections of said J sensors to be all in-phase, and selectively reversing said connections of said sensors until $2^{J-1}$ unique phases result, b.i. in one method by successively reversing said terminals of all the said J sensors, for said J≥2, in an ordered sequence of said combinations of said terminal reversals, by sets of (J said sensors taken i at a time), for i=0 to (J-1)/2 if said J is odd, and by said sets of (J sensors taken i at a time), for i=0 to (J-2)/2+1, and said J is even, limited to ((J-1) taken (J-2)/2 at a time) members in the last said set, such that b.i.1. in the zero said set of said sensor terminal reversals, no said sensor is reversed, for said reversal combination set of one said member, and b.i.2. in the first said set of said sensor terminal reversals, if said J≥2, only one said sensor at a time is reversed, to the number of said J sensors taken 1 at a time, unless said J=2, then said single sensor reversal occurs only once, and if said J=3, then said single sensor reversals occur only 3 times, and b.i.3. in the second said set of said sensor terminal reversals, if said J≥4, 2 of said sensors at a time are reversed, uniquely, such that no pattern of said reversals is repeated, and said reversal continue to said J sensors taken 2 at a time, unless said J=4, then said sensor reversals of 2 each occur only 3 times, and if said J=5, then sensor reversals of 2 each occur only 10 times, and b.i.4. so on, increasing the number of times said J sensors are reversed at a time, b.i.5. until if said J is odd, then said pattern of said sensor reversal combinations is continued to said J sensors taken (J-1)/2 times, such that there are never more than $2^{J-1}$ of said reversals of any number of said J sensors taken any number at a time, and b.i.6. if J is even, then said pattern of said sensor reversal combinations is continued to said (J sensors taken (J-2)/2), plus said J sensors taken ((J-2)/2+1 times), to the limit of said members of (J-1 sensors taken (J-2)/2 times), such that there are never more than $2^{J-1}$ of said reversals of any number of said J sensors taken any number at a time.

2. The method of claim 1 where said individual sensors in said categories, said sub-categories and said versions of said categories and said sub-categories, are replaced by JJ number of electromagnetic humbucking pickups, with two internal coils, typically matched, which can be connected in either series or parallel, such that the total number of distinct tonal outputs is increased by the factor $N_{SP}=2^{JJ}$, and the number of phase changes by reversing terminals of said humbuckers in said circuit is $N_{SGN}=2^{JJ-1}$.

3. The method of claim 1 where said individual sensors are replaced by pairs of matched single-sensor, matched such that the outputs of said pickups respond equally to external electric or magnetic fields, also known as hum, and such that:

a. if the sensors be electromagnetic, with magnetic poles and coils, the coils and magnets of said pickups match to substantially demonstrate the same resistance, inductance and capacitance to external measurements, connected together, and b. they are humbucking as pairs, whether connected together in parallel or series, such that, b.i. the external signal is cancelled out by the connection of the pairs, and the desired signal is not, and b.ii. in-phase if both have opposite electrodes or magnetic poles towards said vibrating part which is ferromagnetic of said musical instrument, and b.iii. out-of-phase, otherwise known as contra-phase, if said pickups have the same electrodes or magnetic pole up, and b.iv. the phase of the pair with respect to the rest of the collection of said pickups in said topology can be reversed by reversing the two terminals of the pair, and c. humbucking in series and parallel topological categories or sub-categories, such that said pickups between two connection points, of some number designated by Je, an even number, are connected either all in parallel or all in series, otherwise known as a basic topology, and the number of possible humbucking phases by reversing or moving the order of the connections of pairs of said pickups within the sub-topology is on the order of (Je-1) things taken (Je/2−1) at a time, d. humbucking in symmetrical circuit topologies with two output terminals, with an even number of said pickups, Je, such that said topology in symbolic diagram is symmetrical up-down and left-right, so that exchanging any two of said sensors, without changing their relative phase to the output of said symmetrical topology does not change the phase, amplitude or tone of said symmetrical topology, and the number of possible humbucking phases gained by reversing or moving the order of the connections of pairs of said sensors in said symmetrical topology is on the order of (Je-1) things taken (Je/2−1) at a time.

4. The method of claim 3 where said sensors are capacitive and piezoelectric sensors which use electrodes, and are placed and wired differentially, such that external electrical field interference is converted to common-mode voltage and the desired signal is passed on as a differential voltage.

5. The method of claim 1 where one or more matched sensors with one pole or electrode directed toward said vibrating part of said musical instrument are connected together in parallel, and said parallel composite connected in series to a similar parallel composite of one or more of said matched sensors with the other pole or electrode up, such that resulting circuit is humbucking, with either comprising an even or an odd total number of said sensors.

6. A digitally-controlled analog switching system for two or more vibration sensors, with the means to switch or shift approximately monotonically from tones of lower predominant frequency, otherwise known as dark or warm tones, to tones of higher frequency, otherwise known as bright tones, by means of simple mechanical or touch-swipe shift controls, symbolic status indicators, a digitally-controlled solid-state analog switching system, digital sampling of switching system signal outputs, digital calculation of signal characteristics, pre-amplification, gain setting, and output conditioning system, such that the musician or system user need never know which sensors are used in what configurations to achieve a given output signal, comprising:

a. two or more of said vibration sensors, including electromagnetic, piezoelectric, optical, proximity, hall-effect and magneto-strictive sensors, otherwise known as pickups, and b. a conventional digitally-controlled M×N analog crosspoint switch, where M is the number of said pickup terminals or greater, and N is equal to or greater than the number of said pickup terminals plus two or more, for output terminals, so that said pickups/sensors can be connected together in any desired circuit configuration, otherwise known as circuit topology, and c. for the purpose of switching said output of said switching system in sequence between the warmest to the brightest of tones produced by the topological circuit connections of said sensor and pickups in said analogy switch, a manual input to control the direction of switching along any sequence of said tones, to set said sequence of said tones, and to change modes of operation of said switching system, and d. a display for indicating the status of said switching system, and e. a programmable micro-controller, with suitable analog and digital inputs and outputs, configured to:

e.i. provide interface, control and interpretation of said manual control inputs, including mechanical switches, and other controls, including x-y tablet entry controls, known as touch-swipe controls, and e.ii. provide control of said status display, including simple on-off lights, alphanumeric displays, digital alphanumeric and graphic panel displays, and digital alphanumeric and graphic panel displays under said touch-swipe controls, and e.iii. provide programmed and programmable, digital or analog sensing of the individual status of said sensors or pickups, including the orientation of electromagnetic pickup field orientation, so as to assure proper humbucking connections and outputs, and e.iv. provide programmed and programmable connections of the said sensors, via said analog cross-point switch to provide a sequence of outputs with measurably and uniquely different tones or timbres, and e.v. provide programmed and programmable gain control of a preamplifier at an output of said analog cross-point switch, so as to maintain substantially equal signal strengths at the output of said switching system, regardless of switching state, and e.vi. provide a means, including an analog-to-digital converter and associated programming, to monitor the signal output of said preamplifier as a means of feedback to said preamplifier for maintaining said output signal strength at constant levels, and to digitize output signals to obtain spectral or Fourier analyses, and e.vii. provide a means of outside input, via conventional USB or BlueTooth or other serial digital connections, so as to change and update the internal program and said sequencing of said output tones, and e.viii. provide a means of using said manual and touch-swipe controls to manage said internal program, including setting desired presets of the sequence of tones provided by the successive exercise of said manual shift controls, and change any modes of microcontroller programming and operation, and e.ix. provide the programmed and programmable means to receive analog feedback of signal from the output of said preamplifier, so as to conduct spectral analysis of the signals of each of said sensor switching states and topologies, using methods including Fast-Fourier Transform methods and statistical methods to characterize the tonal content of said signals from said sensor switching states and topologies, so as to choose and set the order of tones at said output, achieved by the actions of said manual controls, and f. said analog preamplifier at the output of said analog cross-point switch, including single-ended and differential amplifiers, with a gain setting circuit controlled by said micro-controller, and g. said analog output signal conditioning, including volume and tone control of conventional type, and any non-linear analog distortion, and any switching between linear and non-linear signal conditioning.

7. In the digitally-controlled switching system of claim 6, said manual input comprised of one or more debounced mechanical switch connections to:

a. move up and down any sequence of output tones programmed into said microcontroller, and b. change said sequence of tones in said microcontroller's program to any other desired sequence of tones, and c. make any desired changes to the modes of operation of said microcontroller, including for changing said sequence of tone and including communication without outside sources, for the purpose of updating said program of said microcontroller and for the purpose of changing said sequence of tones from said outside source, and d. change the mode of operation of said display.

8. In the digitally-controlled switching system of claim 6, said manual input comprised of a computer mouse-like wheel, with both rotation and one or more debounced mechanical switches, including switches that operate on wheel depression or side-to-side motion, for the purpose of moving along any sequence of said tones, changing the order of said tones, changing the model of operation of said microcontroller, changing the mode of operation of said display, and controlling communication with any outside source.

9. In the digitally-controlled switching system of claim 6, displays of said sequence of said tones, the modes of operation of said microcontroller, the modes of communication of said microcontroller with any outside sources, and the modes of programming and re-programming said microcontroller, including simple binary lights, multiple colored lights, alphanumeric segment displays and dot-matrix panel displays, including any of said displays incorporated with said manual inputs, including touch and swipe inputs.

10. In the digitally-controlled switching system of claim 6, said manual input comprising of touch-and-swipe controls, for the purpose of controlling and managing modes of operation of said switching system and said microcontroller.

11. In the digitally-controlled switching system of claim 6, microcontroller programming and circuits to perform FFT signal analysis, via an analog-to-digital converter in said microcontroller, which generates a digitized spectrum or spectra of said outputs of said switching system, and from said digital spectrum calculates the mean frequency and higher moments of said spectrum or spectra, for the purpose of:

a. displaying the order of tone for each of the sensor circuit topologies achieved by said switching system, and b. automatically ordering, by means of said programming of said microcontroller, said sequence of said tones monotonically in either direction between brightest and warmest, and c. allowing the user of said system to arrange said sequence of said tones in any other desired sequence, and d. generating the average signal level of each of said circuit topologies of said sensors and pickups, for the further result that said programming of said microprocessor adjusts said signal levels to substantially equal in output, as perceived by the user.

12. In the digitally-controlled switching system of claim 11, wherein said signal or signals for said spectral analysis are generated by any excitation of said vibrating part or parts of said musical instrument, including:

a. manually exciting one or more of said vibrating parts of said musical instrument over a wide range of frequencies, and b. manually exciting said vibrating parts of said musical instrument to produce a standard chord or musical sequence of notes, and c. automatically exciting one or more of said vibrating parts of said musical instrument by means of a device attached to said instrument and controlled by said microcontroller via USB or other digital control native to said microcontroller and said programming.

13. The digitally-controlled switching system of claim 11 wherein a math processing unit with floating-point trigonometric functions is added to the system and connected to the micro-controller, because the micro-controller does not have the floating-point trigonometric functions needed to calculate an FFT.

14. A switching system whereby two or more matched pickups, including matched single-coil pickups, dual-coil humbuckers and dual-sensor humbucking hall-effect pickups, are connected together to produce the maximum number of unique and distinct humbucking tones with the minimum number of commonly-available components, comprised of:

a. a pre-switching circuit, comprised of one or more double-throw switches, configured to each connect a set of paired and matched sensors, with four terminals, between parallel and series connections, making said pair into a single two-terminal device, and b. a second pre-switching circuit, comprised of one or more switches, configured to select between three or more two-terminal sensors, so as to present a smaller set of terminals to the output of said second circuit and the input of the following switching circuit, and c. a main switching system, said following switching circuit, which takes two or more of said matched two-terminal sensors, and makes all-humbucking circuit connections at the output of said main switching system.

15. In the switching system of claim 14, a switching system for dual-sensor humbucking pickups, comprised of, a. for each of two or more of said humbucking pickups, a switch that selects between series and parallel configurations of said dual sensors or coils, such that said sensors or coils are in-phase with each other, and b. which feed into the pre-switching circuit of claim 14, to select two humbucking pickups at a time, designated AB and CD, and c. which feeds into the main switching circuit, a switch of three to six poles and six throws, which interconnects the two said AB and CD pickups into circuits of (−AB)+CD, (−AB)||CD, AB, CD, AB+CD and AB||CD, as seen at a two-terminal output of said switching system, wherein (−AB) means and out-of-phase connection, "+" means a series connection, and "||" means a parallel connection.

16. The switching system of claim 15, wherein only two of said dual-sensor humbucking pickups are present, and the switching system of claim 15 is not present or used.

17. In the switching system of claim 14, wherein said switching circuit of claim 14 contains passive components to adjust the tone and volume of the series and parallel connections.

18. In the switching system of claim 14, concatenated switches of P poles each, such that one end of the throw range of a said switch in the concatenated sequence connects to the poles of the next said switch, so as to extend the number of throws to the next switch, for a total number of throws, $M_T$, comprising, a. J number of switches of P poles and Mi throws each, i=1 to J, such that $M_T = M_1 + \ldots + Mi + \ldots M_J + 1 - J$, the poles of the first said switch in said sequence, designated by i=1, with $M_1$ throws, b. with one of the $M_1$ throws, typically the last, connected to the poles of the next switch, and so on, c. until the last switch in the sequence, designated by i=J, has no poles connected to the throws of any other switch.

19. In the switching system of claim 18, where a throw of the last switch, designated by i=J, may be connected to any other throw in the sequence of $M_T$ throws, and $M_T = M_1 + \ldots + Mi + \ldots M_J - J$.

20. The switching system of claim 14, where 3 or more matched single-sensor pickups are used in another embodiment which produces all humbucking circuits, comprising of said switch in claim 14, such that for three matched pickups, one north-up, designated N1, and two south-up, designated S1 and S2, can be connected by said switch to produce the outputs (−S1)||S2, (−S1)+S2, N1||S1, N1||S2, N1+S1, N1+S2, N1+(S1||S2) and other possible humbucking outputs, wherein "−" indicates reversed terminals and phase, "+" indicates a series connection, "||" indicates a parallel connection, "(−)" indicates a single sensor inverted and "( )" indicates a group of sensors connected together.

21. The switching system of claim 14, wherein said series-parallel switching circuit feeds into a fully-differential amplifier, including passive components to adjust the relative tone and volume of said series and parallel outputs, so as to isolate said dual-sensor humbucking pickup from the rest of said circuits, and to provide common-mode noise rejection from said pickup to the rest of said circuits.

22. The switching system of claim 14, where said pickup is a matched single-sensor, and where said series-parallel switch is used instead for volume and tone adjustment, and feeds into fully differential amplifier, to isolate said single-sensor pickup from other circuit loads, and to provide common-mode noise rejection from said pickup to the rest of said circuits.

* * * * *